US011820580B2

(12) United States Patent
Welle

(10) Patent No.: US 11,820,580 B2
(45) **Date of Patent: *Nov. 21, 2023**

(54) THERMALLY INSULATING HOLDER FOR DISPOSABLE BEVERAGE CUPS

(71) Applicant: Richard Patrick Welle, Sunset Beach, CA (US)

(72) Inventor: Richard Patrick Welle, Sunset Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,613

(22) Filed: Dec. 3, 2021

(65) Prior Publication Data

US 2022/0119188 A1 Apr. 21, 2022

Related U.S. Application Data

(63) Continuation of application No. 17/214,814, filed on Mar. 27, 2021, now Pat. No. 11,225,369.
(Continued)

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01); *A47G 2023/0283* (2013.01); *B65D 2543/00046* (2013.01)

(58) Field of Classification Search
CPC ..... B65D 81/3876; B65D 81/3879; B65D 81/3881; B65D 81/3886; A47G 23/02; A47G 23/0208; A47G 23/0216; A47G 23/0266; A47G 23/04; A47G 2023/0275; A47G 2023/0283; A47G 2023/0291
See application file for complete search history.

(56) References Cited

U.S. PATENT DOCUMENTS 3,766,975 A * 10/1973 Todd ..... A47G 19/2288 165/47
4,163,374 A * 8/1979 Moore ..... F25D 31/007 220/592.01

(Continued)

FOREIGN PATENT DOCUMENTS

EP 3733546 11/2020

OTHER PUBLICATIONS

International Search Report and Written Opinion for PCT/US21/26526 dated Aug. 5, 2021; 16 pages.

(Continued)

*Primary Examiner* — Javier A Pagan
(74) *Attorney, Agent, or Firm* — Snell & Wilmer, L.L.P.; Jaime D. Choi

(57) ABSTRACT

An insulating holder is provided for a conventional disposable beverage cup. The insulating holder includes an upward-facing flange that supports the beverage cup at its peripheral bead and without interfering with a disposable lid that may be fitted to the cup by snap fit over the peripheral bead. The insulating holder further includes a retaining mechanism that holds the disposable cup and lid in the holder without interfering with the ability of the user to drink from the cup. The insulating holder further includes means to facilitate insertion of the cup into the holder without requiring the user to hold the cup either by its bead or by the lid.

37 Claims, 17 Drawing Sheets

Related U.S. Application Data

(60) Provisional application No. 63/011,780, filed on Apr. 17, 2020.

(56) References Cited

U.S. PATENT DOCUMENTS

| | | | | |
|---|---|---|---|---|
| 4,666,068 | A | 5/1987 | Bush | |
| 4,798,063 | A * | 1/1989 | Rimmer | F25D 3/08 62/457.4 |
| 4,974,741 | A * | 12/1990 | Gustafson | B65D 81/3886 D7/511 |
| 5,022,235 | A * | 6/1991 | Grissom | F25D 3/08 62/530 |
| 5,040,719 | A | 8/1991 | Ballway | |
| 5,820,016 | A | 10/1998 | Stropkay | |
| 5,839,596 | A | 11/1998 | Zahn | |
| 6,367,652 | B1 * | 4/2002 | Toida | B65D 25/2811 220/592.16 |
| 7,686,183 | B2 | 3/2010 | Ziegler | |
| 7,922,031 | B1 | 4/2011 | Prince | |
| RE42,421 | E | 6/2011 | Toida | |
| 8,276,776 | B2 | 10/2012 | Roth | |
| 8,336,732 | B1 | 12/2012 | Tobias | |
| 8,668,106 | B1 | 3/2014 | Joy et al. | |
| 9,108,776 | B2 | 8/2015 | Smyers | |
| 9,655,463 | B2 | 5/2017 | Madala | |
| 9,988,202 | B2 | 6/2018 | Haas | |
| 10,005,608 | B1 | 6/2018 | Jacob | |
| D830,788 | S * | 10/2018 | Petrillo | D7/624.2 |
| 10,093,462 | B2 | 10/2018 | McArthur | |
| 10,173,872 | B2 | 1/2019 | Foote | |
| 10,279,721 | B1 * | 5/2019 | Nelson | B60N 3/103 |
| 10,441,102 | B1 | 10/2019 | Bunting | |
| 10,457,471 | B2 * | 10/2019 | Jacob | B65D 47/06 |
| 10,494,156 | B2 | 12/2019 | Alvarez | |
| 10,595,653 | B1 | 3/2020 | Messilaty | |
| 10,624,477 | B1 | 4/2020 | Messilaty | |
| 10,703,553 | B2 | 7/2020 | Haas | |
| 10,787,304 | B2 | 9/2020 | Haas | |
| 10,888,185 | B2 | 1/2021 | Messilaty | |
| 10,974,889 | B2 * | 4/2021 | Callinan | B65D 81/3886 |
| 11,225,369 | B2 * | 1/2022 | Welle | B65D 81/3876 |
| 2002/0088810 | A1 * | 7/2002 | Murakami | B65D 81/3881 220/739 |
| 2009/0107947 | A1 | 4/2009 | Knaack | |
| 2015/0122828 | A1 | 5/2015 | Madala | |
| 2016/0022074 | A1 | 1/2016 | Martin | |
| 2017/0119186 | A1 | 5/2017 | Rivera | |
| 2020/0339313 | A1 | 10/2020 | DiDato | |

OTHER PUBLICATIONS

Notice of Allowance dated Sep. 22, 2021 in U.S. Appl. No. 17/214,814; 12 pages.

Non-Final Office Action dated Jun. 15, 2021 in U.S. Appl. No. 17/214,814; 9 pages.

Non-Final Office Action dated Oct. 18, 2022 in U.S. Appl. No. 17/697,785; 16 pages.

Final Office Action dated Apr. 20, 2023 in U.S. Appl. No. 17/697,785; 17 pages.

* cited by examiner

THERMALLY INSULATING HOLDER FOR DISPOSABLE BEVERAGE CUPS

CROSS-REFERENCE TO RELATED APPLICATIONS

This application is a continuation under 35 U.S.C. § 120 of U.S. patent application Ser. No. 17/214,814 filed Mar. 27, 2021 and entitled "THERMALLY INSULATING HOLDER FOR DISPOSABLE BEVERAGE CUPS," which claims the benefit of U.S. Provisional Patent Application Ser. No. 63/011,780 filed Apr. 17, 2020, the entire contents of each of which applications are hereby incorporated by reference herein.

BACKGROUND OF THE INVENTION

The present invention relates to cup holders, and more specifically, to insulating cup holders for disposable beverage cups.

Reusable insulating beverage containers, often called travel mugs, are vessels that include inner and outer shells separated from one another by a vacuum or other insulating space. An opening at the top allows beverages to be introduced into the inner shell and consumed therefrom. The top opening is often provided with a secure lid that can be closed to prevent accidental spillage of the beverage during handling and transport of the mug. The insulating quality of such travel mugs ensures that a beverage introduced into the inner shell can maintain a temperature, whether hot or cold, substantially different from the temperature of the surrounding environment for an extended period of time in comparison to uninsulated beverage containers.

While such travel mugs can be conveniently filled with beverages in a home setting, their utility for beverages sold over the counter, such as specialty coffees, is limited because vendors of such beverages are often not willing to dispense such beverages directly into personal travel mugs. Indeed, vendors may be prohibited by regulation from dispensing directly into such travel mugs for health reasons. Furthermore, when a travel mug is used, it is often preferable to clean the mug before reuse, which may not be convenient for travel mugs kept, for example, in automobiles for beverage consumption while driving.

Over-the-counter beverages, such as specialty coffees, are typically sold in uninsulated disposable plastic or paper cups, which are often provided with disposable lids to prevent spillage. It is known, however, that such lids can be unreliable because the fit between the lid and the cup, typically a snap fit between a radially-outward-extending peripheral bead on the cup and a corresponding recess in the lid, depends on consistent manufacture and consistent application by the beverage vendor after the cup is filled. If the lid is not properly attached to the cup it can leak or become dislodged, resulting in spillage of the beverage.

Toida et al. (U.S. Pat. No. 6,367,652) disclosed an insulating cup holder into which a disposable beverage cup can be inserted, thereby providing the thermal insulating capability of a travel mug for use with a disposable beverage cup. However, the cup holder disclosed by Toida et al. included an unbroken upward-facing flange on the side wall to support the cup through contact with the underside of the peripheral bead on the cup. In this configuration, it is not possible for the user's fingers to remain in contact with the outside of the disposable cup, except with the peripheral bead if the disposable lid is not yet attached, while the cup is being fully inserted into the cup holder. As such, if the lid is attached, it would be necessary to hold the cup by the lid for insertion into the insulating holder, posing a risk that the lid would come off during the insertion process, thereby potentially spilling the beverage if the cup is filled with a beverage at the time it is inserted into the cup holder. Alternatively, if the lid is not yet attached, it would be necessary to hold the cup by the bead as it is inserted. This may be problematic since the bead is typically not large enough to provide a reliable hold on the cup, again posing a risk of spilling the beverage. Furthermore, the design of Toida et al. did not include provisions for securing the lid or cup in place once the cup was inserted into the holder.

The present invention is directed to overcoming one or more of the above deficiencies in the prior art.

BRIEF SUMMARY OF THE INVENTION

It is an object of the present invention to provide an improved holder for a disposable beverage cup. It is further an object of the present invention to provide an insulated holder for a disposable beverage cup. It is further an object of the present invention to provide a holder for a disposable beverage cup wherein the disposable beverage cup can be manually inserted fully into the holder while maintaining contact with the outer surface of the cup. It is further an object of the present invention to provide a holder for a disposable beverage cup wherein the disposable beverage cup and lid can be secured within the cup holder.

An exemplary embodiment of the invention achieves one or more of these objects in an insulating holder configured to securely contain a disposable beverage cup while limiting the flow of heat to or from the contents of the cup. Disposable beverage cups typically have an inverted frustoconical side wall, a closed bottom, and an upper opening surrounded by a radially-outwardly-extending peripheral bead sized to be mated with a corresponding peripheral groove in a disposable lid by means of a snap fit. The insulating holder of the present invention is a vessel with insulating walls having an upper access opening shaped to receive the disposable beverage cup, with the top edge of the holder side wall abutting the bottom of the peripheral bead.

In one embodiment, a cup holder includes an insulating vessel for accepting a disposable beverage cup and a retaining mechanism for securely holding the cup and lid in the holder when in use.

In another embodiment, the side wall of the cup holder incorporates two or more gaps sized to allow the cup to be held by the side wall below the lid with two or more fingers while inserting the cup into the holder.

In another embodiment, the retaining mechanism is secured by means of a threaded connection.

In another embodiment, the retaining mechanism is secured by means of a snap fit.

In another embodiment, the retaining mechanism is secured by means of a magnetic connection.

In another embodiment, the retaining mechanism is secured by means of a rotary clamp connection.

In another embodiment, the retaining mechanism is configured to cover the two or more gaps when the retaining mechanism is secured to the insulating cup holder.

In another embodiment, the retaining mechanism comprises one or more retractable clamps that provide a downward force on the shoulder of the lid.

In another embodiment, the retaining mechanism incorporates a modified disposable lid.

In another embodiment, insertion of the cup into the insulating cup holder is facilitated by a cup support ring.

In another embodiment, a drinking port cover is provided to minimize the potential for spilling the contents of the cup.

In another embodiment, an electrical resistance heater is provided to maintain the contents of the cup at a temperature above that of the environment.

In another embodiment, a thermoelectric element is provided to maintain the contents of the cup at a temperature above or below that of the environment.

In another embodiment, the holder is a double-walled vessel with an evacuated gap between the walls to minimize heat flow.

DETAILED DESCRIPTION OF THE INVENTION

Figure 1A:
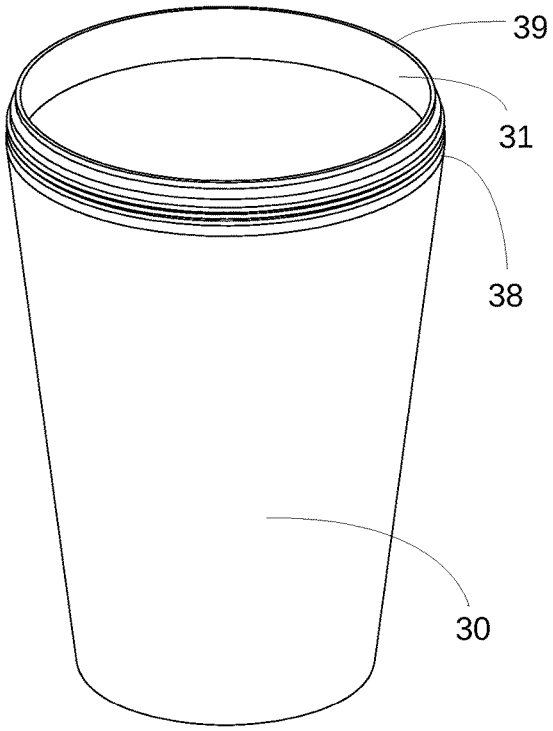
FIG. 1A shows a perspective view of a cup holder with a threaded connection for attaching a cup retaining means.
Figure 1B:
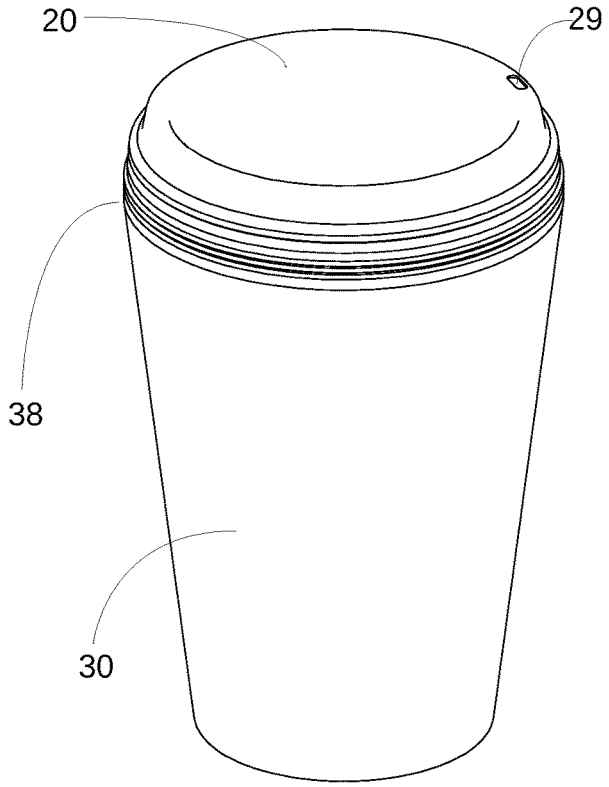
FIG. 1B shows a perspective view of the cup holder of FIG. 1A containing a disposable cup and lid.
Figure 1C:
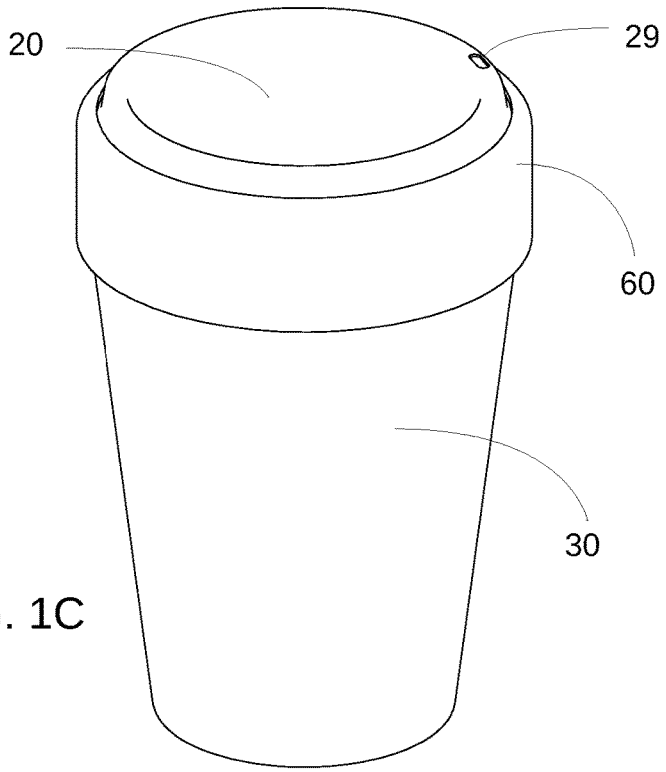
FIG. 1C shows a perspective view of the cup holder of FIG. 1A containing a disposable cup and lid secured in place by a detachable retaining ring.

An exemplary embodiment of the invention is illustrated in FIGS. 1A through 1E and is seen to include a conventional, disposable beverage cup 10, a conventional disposable lid 20, a cup holder 30, and a releasable cup retaining means 60. Cup 10 may be made of plastic, paper, or paper coated with materials such as plastic or wax, depending on the nature of the beverage for which it is intended. The cup walls 16 take the shape of an inverted truncated cone, with generally flat and parallel top and bottom. The bottom 12 is closed with a generally flat or slightly domed surface, which may be offset from the bottom edge of the side walls. At the upper edge, the cup includes a radially-outwardly-extending peripheral bead 14, which provides structural rigidity to the circular upper opening of the cup, and provides a mating interface for a disposable lid. As illustrated in FIGS. 1B through 1E, conventional disposable lid 20 includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below peripheral groove 22, such that the skirt provides a guiding surface to assist in aligning the disposable lid for mating on bead 14 of disposable cup 10. Disposable lid 20 also includes a neck 28 leading to an elevated section containing a drinking port 29.

Cup holder 30 includes a wall 32 substantially in the form of a truncated inverted cone open at the top and closed at the bottom by a generally flat bottom surface 33. Near its top, wall 32 includes a short substantially cylindrical section 31 and ends in an upward-facing circular flange 39 configured to support cup 10 at the underside of peripheral bead 14. The inner diameter of upward-facing flange 39 is preferably greater than or equal to the diameter of side wall 16 of disposable beverage cup 10 at the level of the bottom of bead 14. Further, the outer diameter of upward-facing flange 39 is preferably less than the inner diameter of skirt 24 on disposable lid 20. These dimensional constraints ensure that bead 14 is able to rest without interference on upward-facing flange 39 when beverage cup 10 with mating lid 20 are together inserted into cup holder 30. Alternatively, beverage cup 10 without lid 20 may be inserted into cup holder 30, with lid 20 being attached to cup 10 after insertion into cup holder 30.

According to an embodiment of the present invention, disposable beverage cup 10 in combination with lid 20 may be retained within cup holder 30 by means of a releasable clamp. In the embodiment illustrated in FIGS. 1A through 1E, the releasable clamp is in the form of a retaining ring 60. Retaining ring 60 includes an inward facing circumferential lobe 64 with an inner diameter not less than the outer diameter of neck 28 of disposable lid 20, and not more than the diameter of the circular line of contact between bead 14 and upward-facing flange 39. Retaining ring 60 further includes a skirt 61 below inward-facing lobe 64. The inner diameter of retaining ring skirt 61 is at least greater than the outer diameter of skirt 24 on lid 20 in order that retaining ring 60 may fit over skirt 24 without interference. Retaining ring 60 further includes a set of retaining ring threads 62 on the inner surface of skirt 61, and cup holder 30 further includes a set of cup holder threads 38 on cylindrical section 31 of wall 32, where retaining ring threads 62 are configured to mate with cup holder threads 38 allowing retaining ring 60 to be detachably secured to cup holder 30. When retaining ring 60 is secured to cup holder 30, lobe 64 will apply a downward force on shoulder 26 of disposable lid 20, which force will apply pressure though lid 20 to bead 14, thereby ensuring that lid 20 remains secured on cup 10 and that the lid and cup together remain securely held in cup holder 30.

According to the embodiment of the present invention illustrated in FIGS. 1A through 1E, upward-facing flange 39 constitutes an unbroken ring configured to interface with peripheral bead 14 of disposable beverage cup 10. When the flange is unbroken, as illustrated in FIG. 1A, it may be difficult to insert a beverage cup containing a liquid beverage into cup holder 30 without risk of spilling some liquid. This is because a filled beverage cup is most easily and securely held by its side walls, while an unbroken upward-facing flange would force the user to hold a beverage cup by its peripheral bead for insertion into cup holder 30. Further, if a filled beverage cup is covered with a disposable lid the bead is no longer accessible and insertion into cup holder 30 would require that the cup and lid combination be held by the skirt of the lid, with the potential that the lid could detach from the bead and spill the contents of the cup. This is clearly illustrated in FIG. 1B, where cup 10 with lid 20 have been inserted in holder 30, but no part of cup 10 is visible, indicating that the user would not be able to maintain contact with cup 10 while inserting the cup and lid combination into cup holder 30.

Figure 2A:
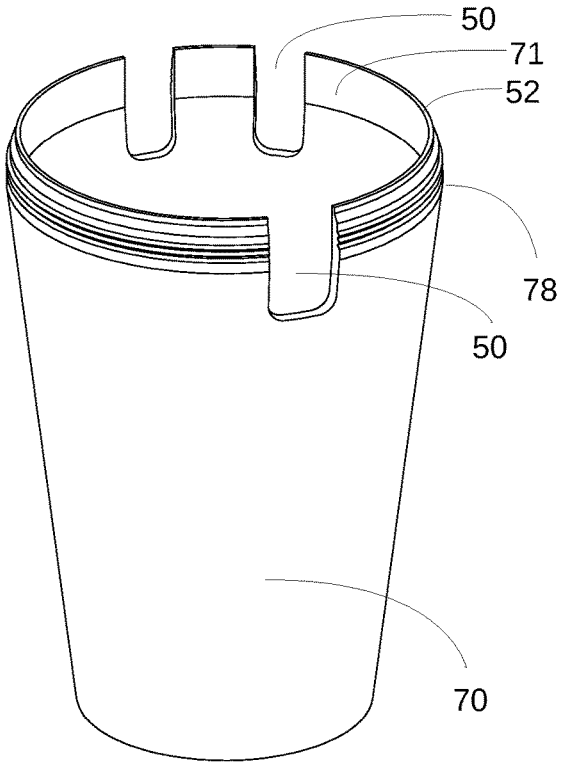
FIG. 2A shows a perspective view of a cup holder with a threaded connection for attaching a cup retaining means and three finger-sized gaps in the wall of the cup holder.
Figure 2B:
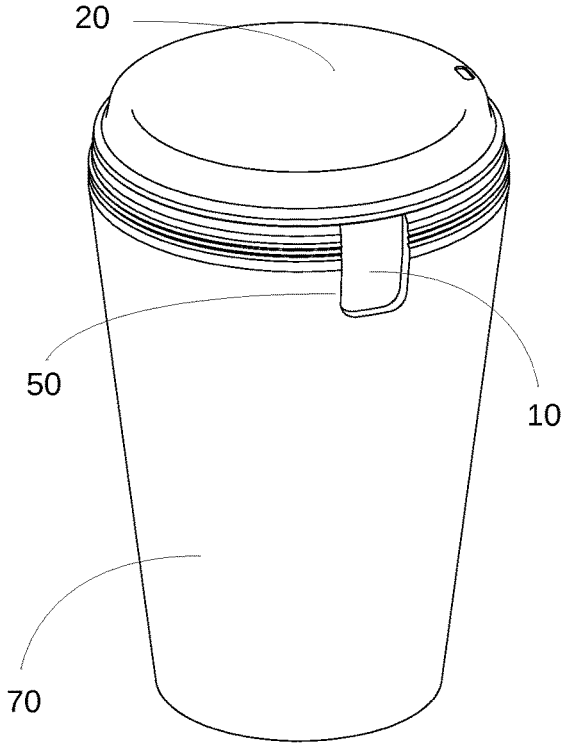
FIG. 2B shows a perspective view of the cup holder of FIG. 2A containing a disposable cup and lid.
Figure 2C:
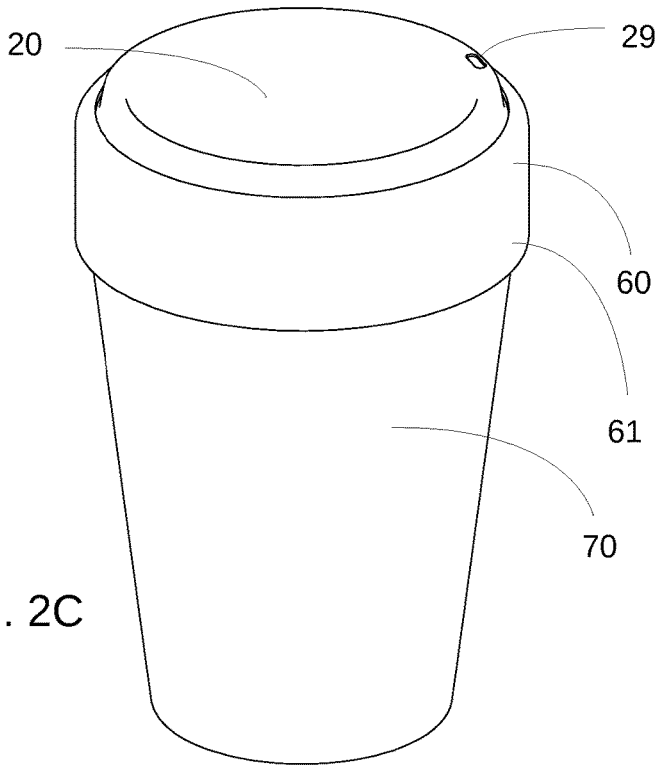
FIG. 2C shows a perspective view of the cup holder of FIG. 2A containing a disposable cup and lid secured in place by a detachable retaining ring.
Figure 2E:
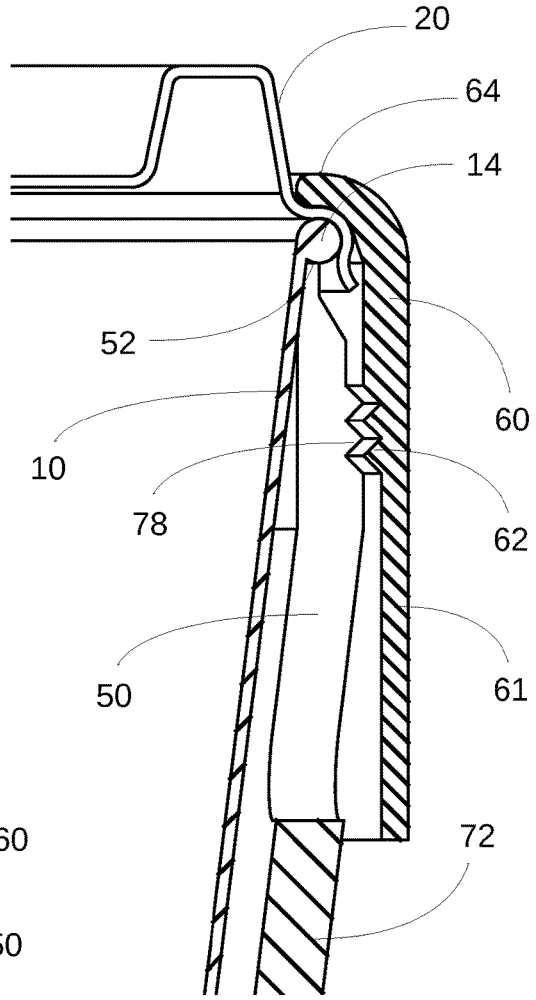
FIG. 2E shows a closeup of a portion of the cup holder, disposable cup, lid, and retaining ring of FIG. 2D.
Figure 2D:
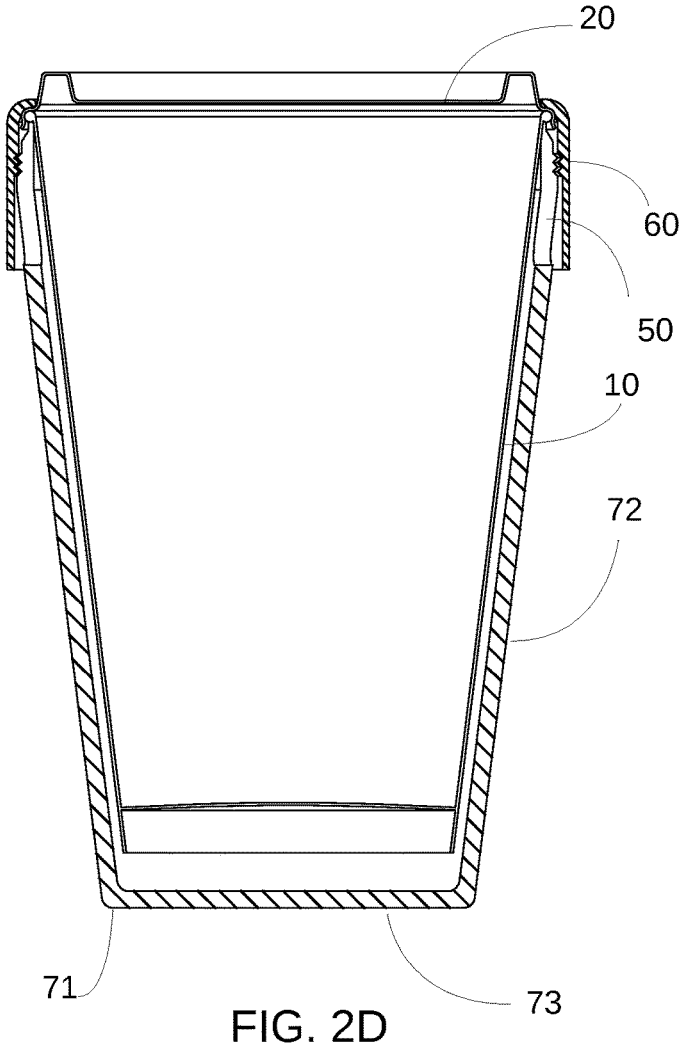
FIG. 2D shows a cross-section view of the cup holder, disposable cup, lid, and retaining ring of FIG. 2C.

According to an embodiment of the present invention illustrated in FIGS. 2A through 2E, a cup holder 70 includes a wall 72 substantially in the form of a truncated inverted cone open at the top and closed at the bottom by a generally flat bottom surface 73. Near its top, wall 72 includes a short substantially cylindrical section 71 and ends in a segmented upward-facing circular flange 52 configured to support cup 10 at the underside of peripheral bead 14. The inner diameter of upward-facing flange 52 is preferably greater than or equal to the diameter of side wall 16 of disposable beverage cup 10 at the level of the bottom of bead 14. Further, the outer diameter of upward-facing flange 52 is preferably less than the inner diameter of skirt 24 on disposable lid 20. Upward-facing flange 52 is broken into segments separated by two or more gaps 50 extending downward into the upper part of wall 72 of cup holder 70. Gaps 50 are sized to allow a disposable cup 10 to be grasped between two or more fingers (where the term "fingers" is understood to include the thumb) as it is being inserted into cup holder 70, and to allow the grip on cup 10 to be maintained until cup 10 is fully inserted into cup holder 70 such that bead 14 is resting stably on segmented flange 52. Gaps 50 may be of a uniform size, or one may be larger than the one or more others to fit the thumb, which is typically larger than the other fingers. Further, gaps 50 are sized to allow finger contact with the walls of disposable beverage cup 10 until the bead rests on segmented flange 52 even when disposable lid 20 is attached to disposable beverage cup 10. This is illustrated in FIG. 2B where cup 10 with lid 20 have been inserted in holder 70 and the side wall of cup 10 is visible through gap 50, indicating that the user would be able to maintain contact with the cup wall throughout the insertion process. Cup holder 70 further includes threads on the cylindrical section 71 of wall 72 configured to mate with threads 62 on retaining ring 60. After cup 10 with lid 20 is fully inserted into cup holder 70, retaining ring 60 may be attached, as illustrated in FIGS. 2C through 2E, to prevent a filled beverage cup 10 from being easily dislodged from cup holder 70.

Insulated holder: According to an embodiment of the present invention, an insulating cup holder 40 is made up of an inner shell 41 and an outer shell 44, separated from one another by an insulating space 47. In an embodiment illustrated in FIGS. 3A through 3E, inner shell 41 includes an inner wall 42 in the form of a truncated inverted cone open at the top, and closed at the bottom by an inner bottom surface 43. Similarly, outer shell 44 includes an outer wall 45 in the form of a truncated inverted cone open at the top, and closed at the bottom by an outer bottom surface 46. At its upper end, inner wall 42 includes a short cylindrical section 155. At its upper end, outer wall 45 includes a short cylindrical section 156 and threads 48 configured to mate with threads 62 of retaining ring 60. The uppermost edges of inner wall 42 and outer wall 45 are joined together forming a segmented upward-facing circular flange 152 along their top-most surfaces, where the segments of flange 152 are separate by gaps 150 sized to allow finger contact with the walls of disposable beverage cup 10 until the bead rests on segmented flange 52 even when disposable lid 20 is attached to disposable beverage cup 10. The inner diameter of upward-facing flange 152 is preferably greater than the diameter of side wall 16 of disposable beverage cup 10 at the level of the bottom of bead 14. Further, the outer diameter of upward-facing flange 152 is preferably less than the inner diameter of skirt 24 on disposable lid 20. The joint between the upper edges of inner wall 42 and outer wall 45 is preferably sealed to form a closed insulating space 47 between inner shell 41 and outer shell 44. Further, the perimeters of gaps 150 may be closed by a wall segment 158 connecting inner wall 42 and outer wall 45 to maintain a seal around insulating space 47. Insulating space 47 may preferably be evacuated to minimize heat transport between the inner and outer walls. Alternatively, insulating space 47 may be filled with an insulating material or may simply be filled with air. Other than along the joint at their upper edges, and along the perimeters of gaps 150, inner shell 41 and outer shell 44 are preferably not in physical contact with one another in order to minimize heat transfer between them.

Figure 3A:
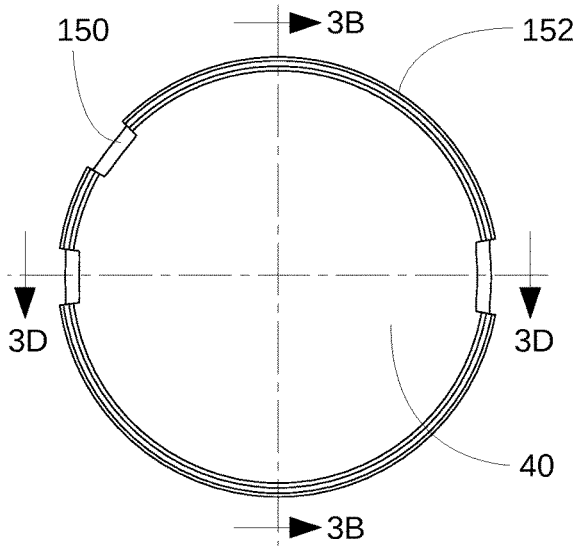
FIG. 3A shows a top view of an insulating cup holder with finger-sized gaps in the wall of the insulating cup holder.
Figure 3C:
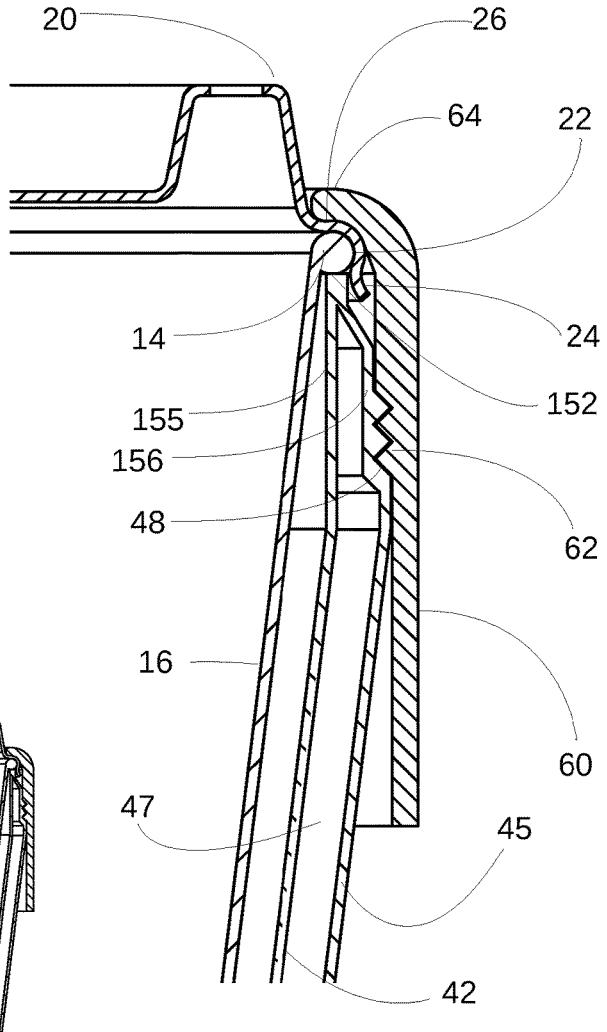
FIG. 3C shows a closeup of a portion of the cup holder of FIG. 3B.
Figure 3B:
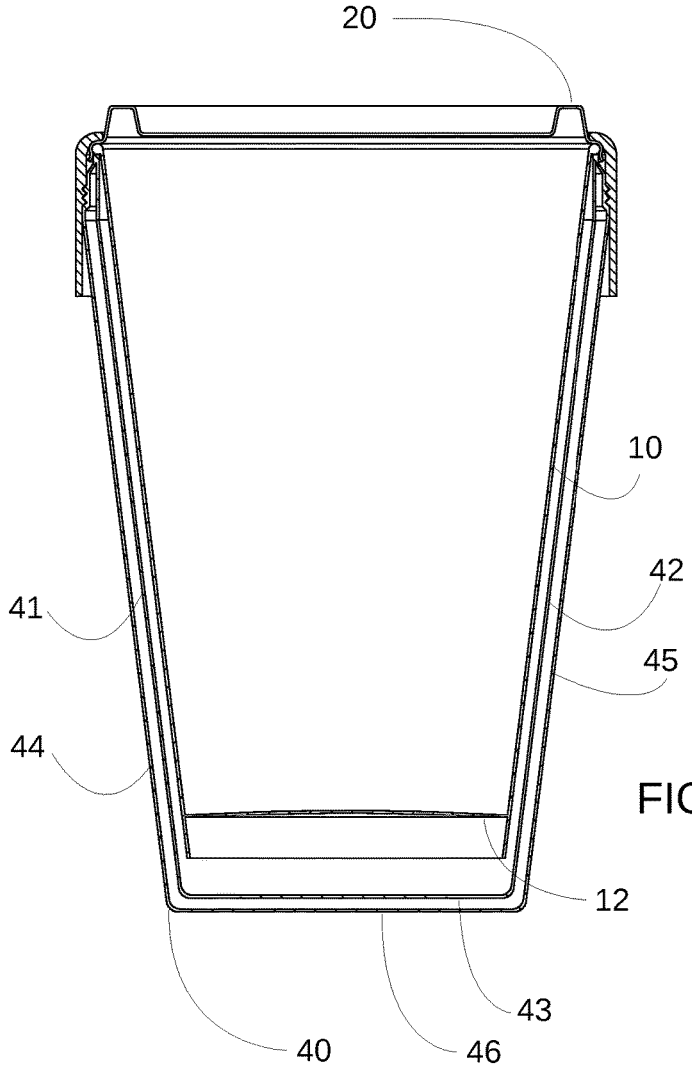
FIG. 3B shows a cross-section view of a disposable cup and lid detachably secured by a threaded retaining ring in the insulating cup holder of FIG. 3A, with the cross section along a plane not intersecting the finger-sized gaps.
Figure 3D:
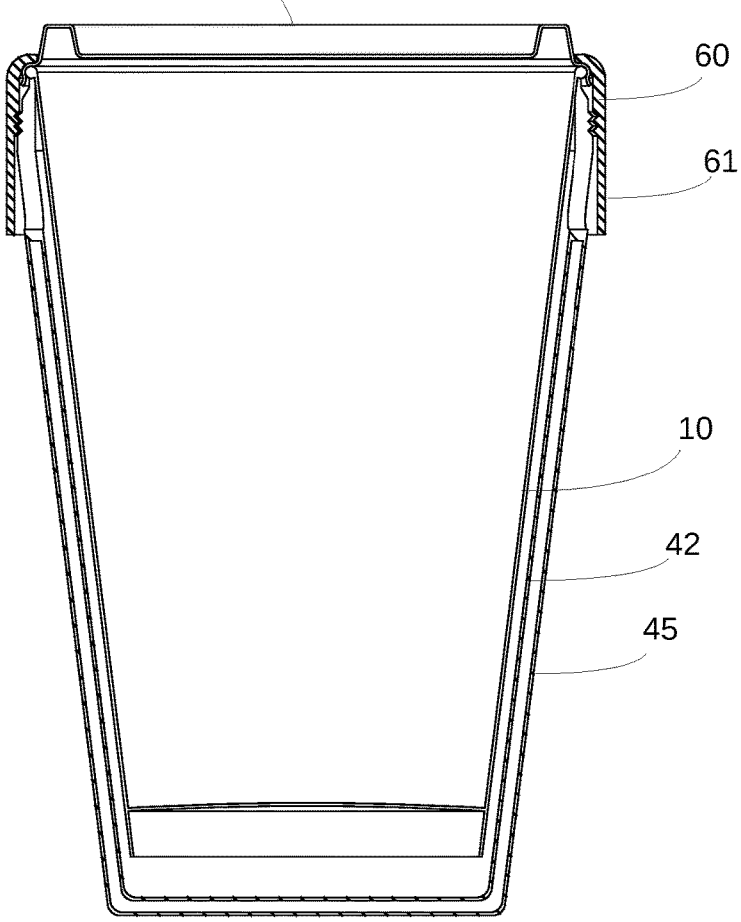
FIG. 3D shows a cross-section view of a disposable cup and lid detachably secured by a threaded retaining ring in the insulating cup holder of FIG. 3A, with the cross section along a plane intersecting the finger-sized gaps.
Figure 3E:
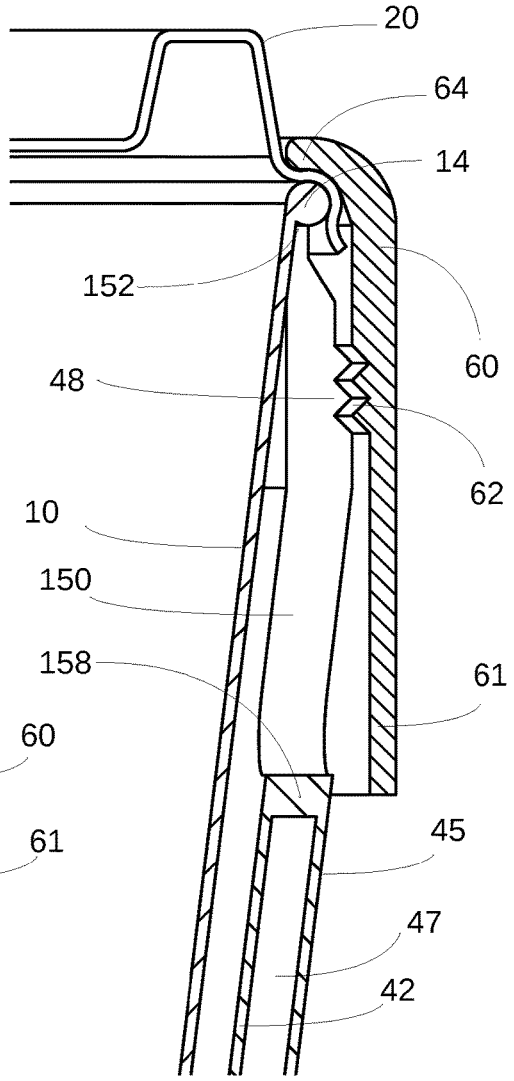
FIG. 3E shows a closeup of a portion of the cup holder of FIG. 3D.

In an embodiment illustrated in cross section in FIGS. 3D and 3E, retaining ring 60 includes a retaining-ring skirt 61 extending downward from inward facing lobe 64 a sufficient distance to substantially cover finger-sized gaps 150 in order to minimize heat transfer to and from disposable beverage cup 10.

Figure 4A:
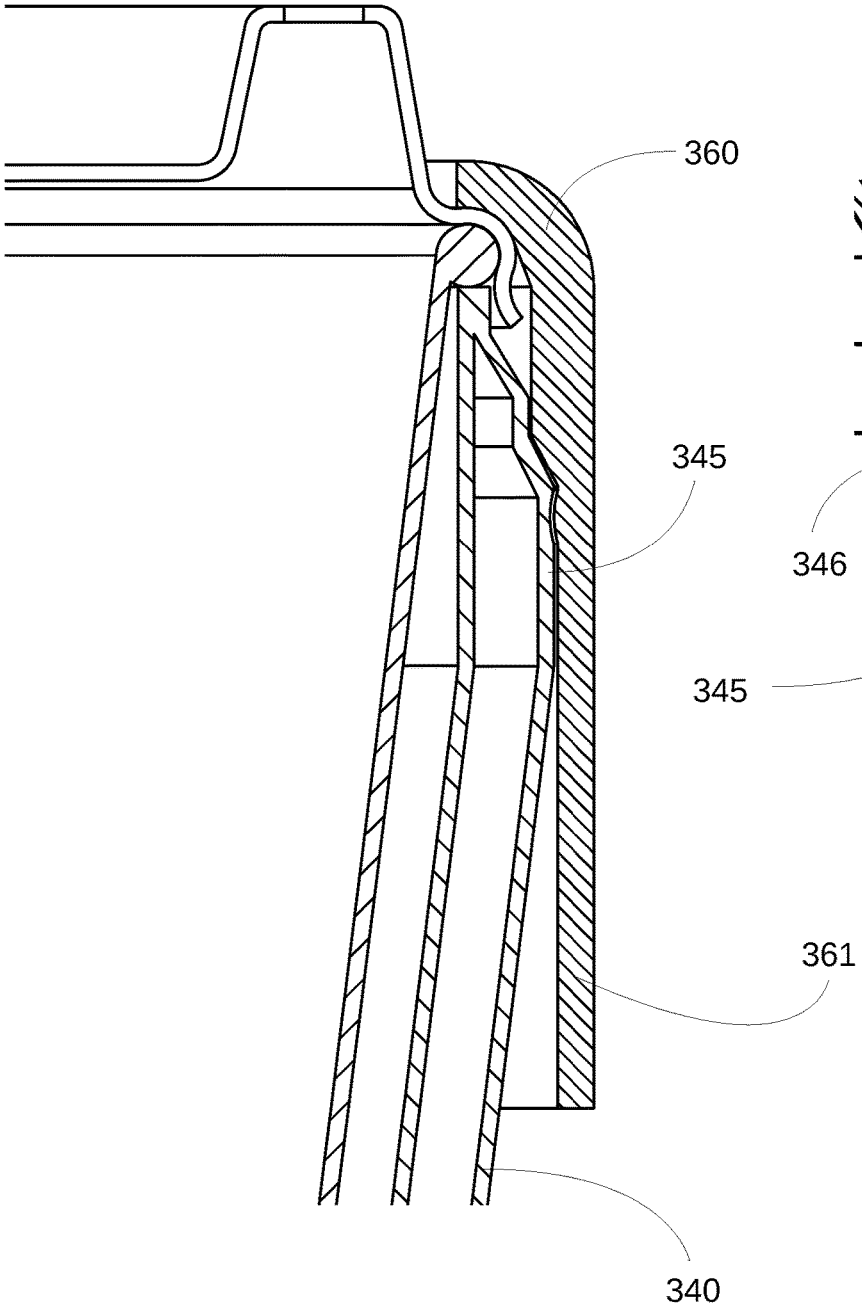
FIG. 4A shows a cross-section view of the upper portion of an insulating cup holder containing a disposable cup and lid secured in place by a detachable retaining ring using a snap fit.
Figure 4B:
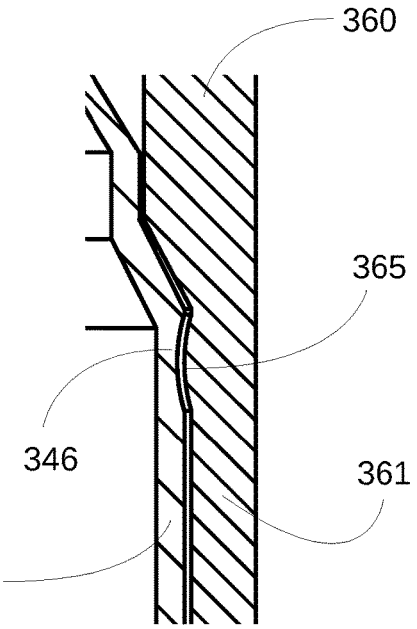
FIG. 4B shows a closeup view of the snap fit in FIG. 4A.

Attachment means: According to embodiments of the present invention illustrated in FIGS. 1 through 3, retaining ring 60 is detachably secured to insulating cup holder 40 by means of a threaded connection. It will be appreciated that alternative means may be used for detachably securing a retaining ring to a cup holder. In an embodiment illustrated in FIG. 4A and in closeup in FIG. 4B, retaining ring 360 is detachably secured to insulating cup holder 340 by means of a snap fit. In this embodiment, outer side wall 345 of insulating cup holder 340 includes an outward-facing circumferential groove 346. Retaining ring 360 included an inward-facing circumferential protrusion as part of skirt 361 sized to mate in a snap fit with circumferential groove 346 when retaining ring 360 is pressed down onto insulating cup holder 340.

Figure 5B:
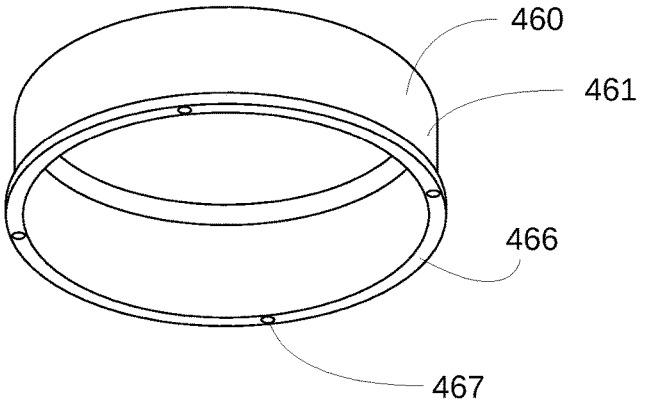
FIG. 5B shows a perspective view of a retaining ring with a magnetic connection.
Figure 5C:
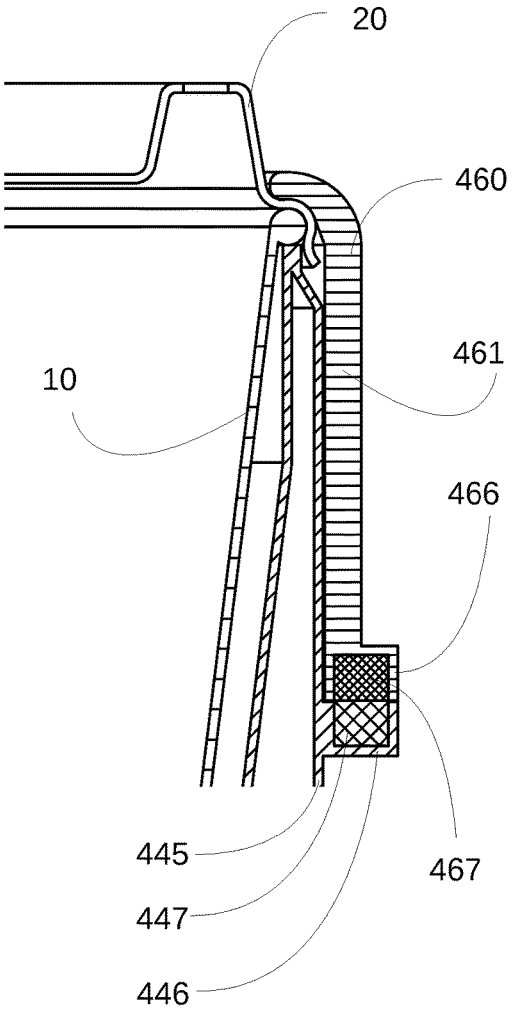
FIG. 5C shows a cross-section view of the upper portion of an insulating cup holder containing a disposable cup and lid secured in place by a detachable retaining ring using a magnetic connection.
Figure 5A:
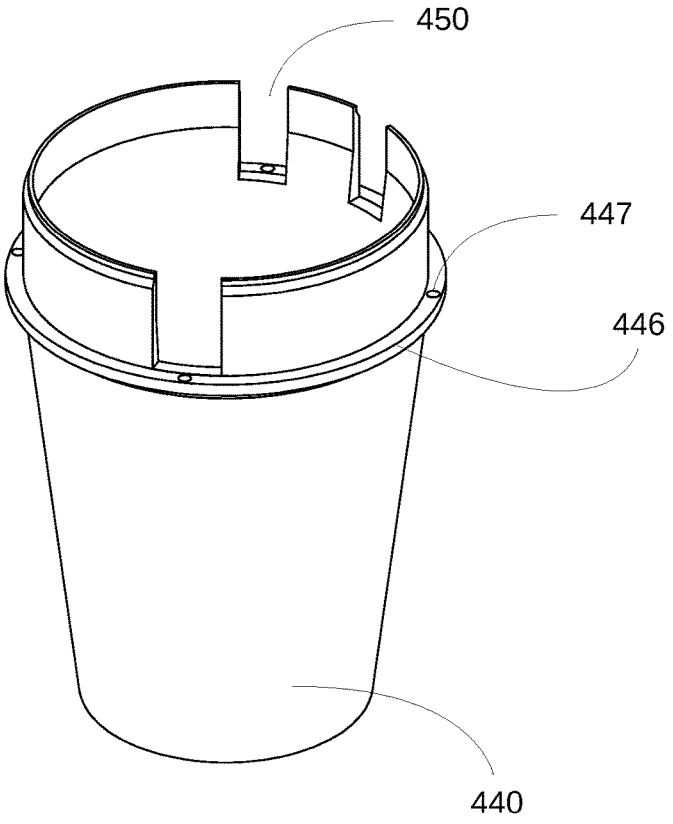
FIG. 5A shows a perspective view of an insulating cup holder with a magnetic connection for a retaining ring.

In another embodiment, illustrated in FIGS. 5A, 5B, and 5C, retaining ring 460 is detachably secured to insulating cup holder 440 by means of magnets. In FIG. 5A, insulating cup holder 440 includes a circumferential flange 446 extending radially outward from outer wall 445 just below finger-sized gaps 450. As shown in FIG. 5A, flange 446 holds four magnets distributed around the circumference. In FIG. 5B, retaining ring 460 includes a circumferential flange 466 extending radially outward from the bottom of retaining ring skirt 461. Flange 466 also holds four magnets distributed around the circumference in the same pattern as flange 446 such that when retaining ring 460 is mounted on cup holder 440 the magnets can attract one another and apply a holding force, thereby securing retaining ring 460 in place. It should be appreciated that, while four magnet pairs are shown for illustration purposes in FIGS. 5A and 5B, the actual number used to secure retaining ring 460 to cup holder 440 may be more or less than four as required to provide the necessary securing force. It should also be appreciated that magnet pairs may be arranged with alternating polarity so that the user may easily release the holding force on retaining ring 460 by twisting the ring so that the magnets in the retaining ring are no longer aligned with magnets of the correct polarity in the cup holder and are instead aligned with magnets of opposite polarity, thereby generating a force tending to push the retaining ring away from the cup holder. The complete assembly, including beverage cup 10 and lid 20, is shown in cross section in FIG. 5C.

Figure 6B:
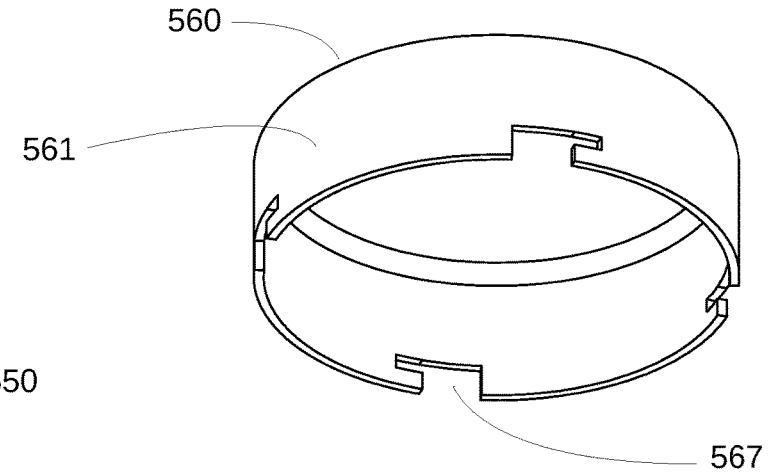
FIG. 6B shows a perspective view of a retaining ring with a twist lock connection.
Figure 6A:
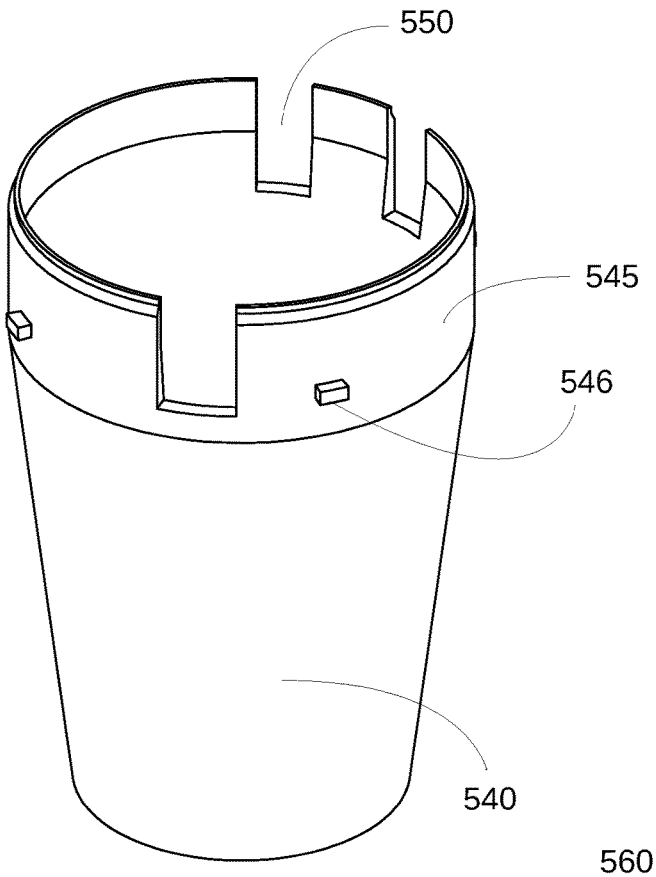
FIG. 6A shows a perspective view of an insulating cup holder configured to mate with a retaining ring using a twist lock connection.
Figure 6C:
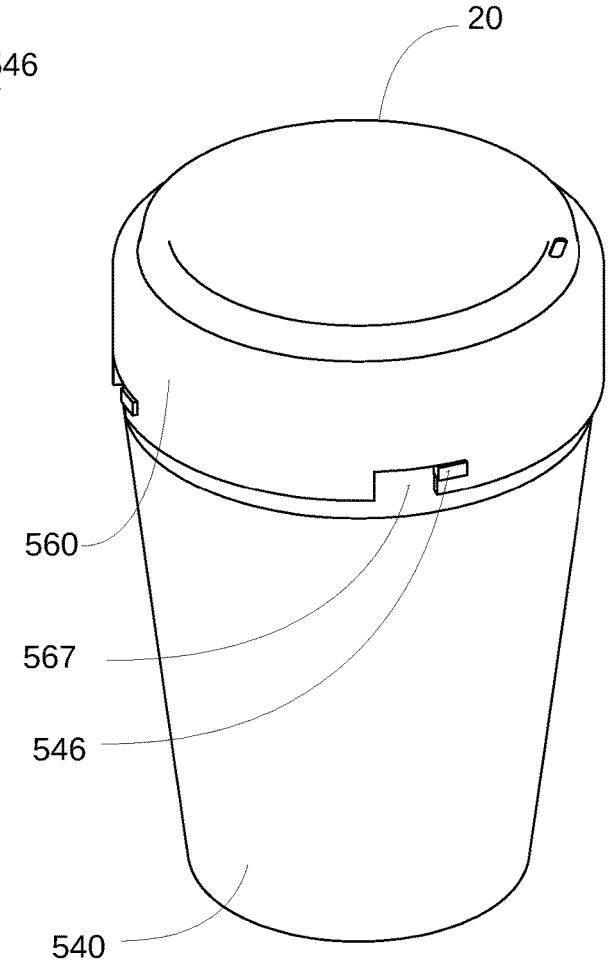
FIG. 6C shows a perspective view of an insulating cup holder containing a disposable cup and lid secured in place by a detachable retaining ring using a twist lock connection.

In another embodiment, illustrated in FIGS. 6A, 6B, and 6C, retaining ring 560 is detachably secured to insulating cup holder 540 by means of a rotary clamping action. In FIG. 6A, insulating cup holder 540 includes a set of protrusions 546 extending radially outward from outer wall 545 just above the bottom of finger-sized gaps 550. In FIG. 6B, retaining ring 560 includes a matching set of slots 567 in the bottom of retaining ring skirt 561. Retaining ring 560 may be secured to cup holder 540 by sliding slots 567 over protrusions 546 and twisting retaining ring 560 to lock slots 567 over protrusions 546 as illustrated in FIG. 6C.

In embodiments as illustrated in FIGS. 1 through 6, the retaining ring may be detached from the insulating cup holder to allow for insertion and removal of beverage cups. In these embodiments, it is possible for the retaining ring to become separated from the insulating cup holder and possibly lost. In other embodiments, means are provided for securing a beverage cup within the cup holder without a separable retaining ring.

Figure 7A:
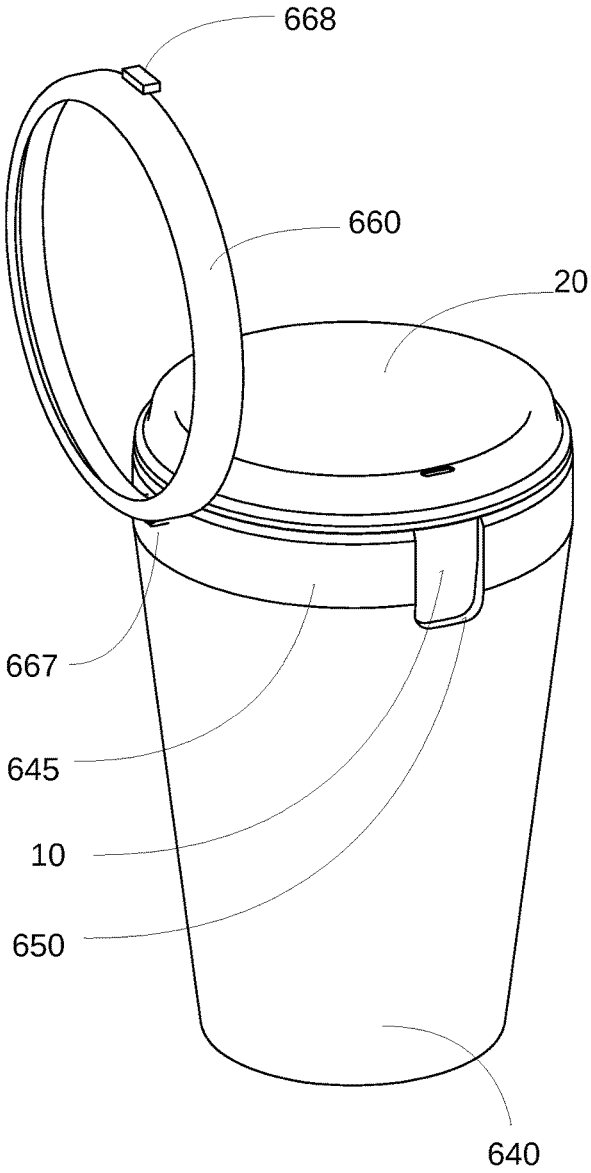
FIG. 7A shows a perspective view of an insulating cup holder containing a disposable cup and lid with a hinged retaining ring in the open position.
Figure 7B:
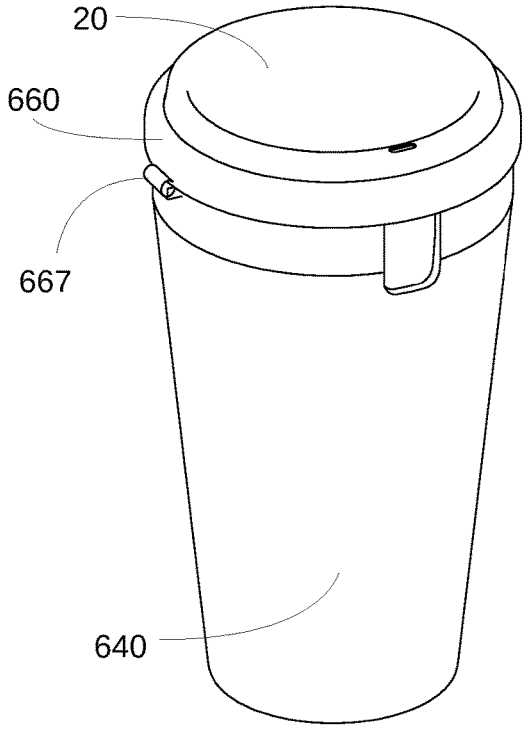
FIG. 7B shows a perspective view of an insulating cup holder containing a disposable cup and lid with a hinged retaining ring in the locked position, seen from the hinge side.
Figure 7C:
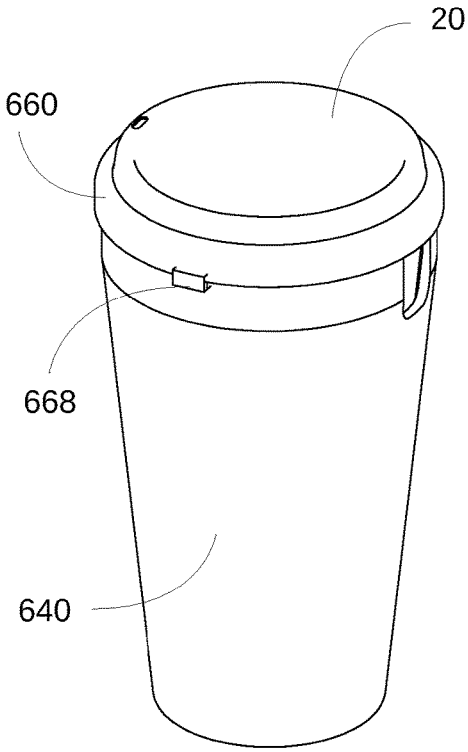
FIG. 7C shows a perspective view of an insulating cup holder containing a disposable cup and lid with a hinged retaining ring in the locked position, seen from the latch side.

In an embodiment, illustrated in FIGS. 7A, 7B, and 7C, retaining ring 660 is attached to insulating cup holder 640 by means of hinge 667, which allows retaining ring 660 to be rotated up and away from the top of cup holder 640 to allow insertion of a beverage cup 10 (visible through finger-sized slot 650) with an attached lid 20 into cup holder 640. After the beverage cup is inserted, retaining ring 660 may be rotated on hinge 667 to a position where it will hold cup and lid 20 in cup holder. Retaining ring 660 may be secured in this position by means of latch 668.

Figure 8A:
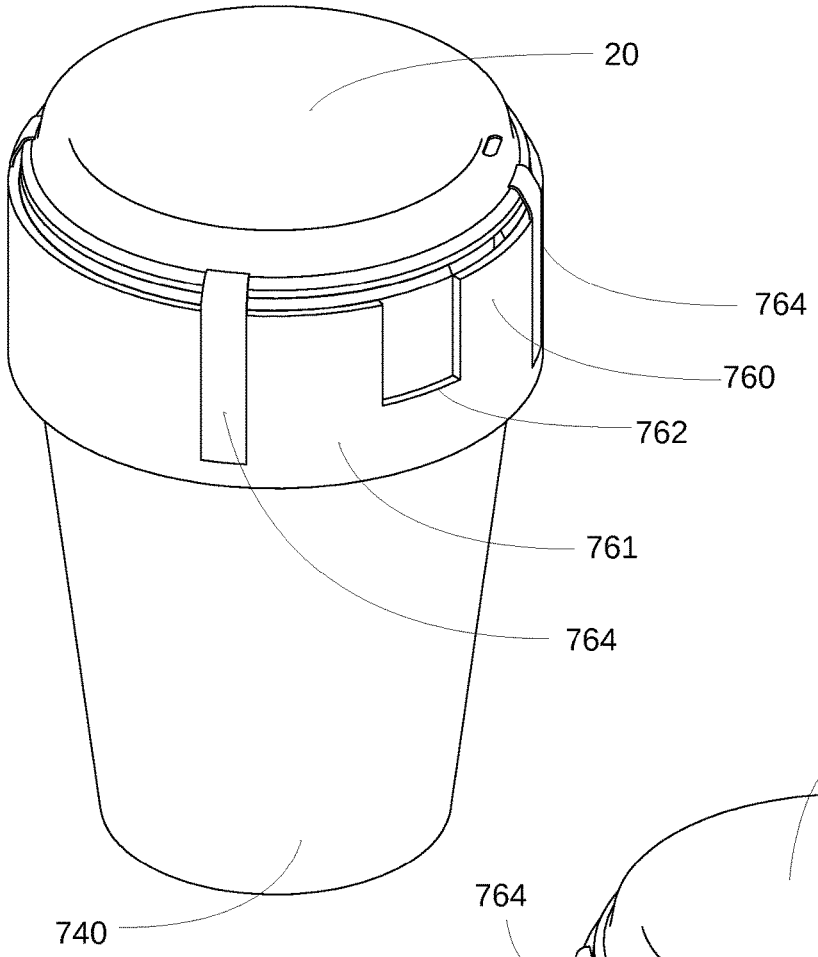
FIG. 8A shows a perspective view of an insulating cup holder containing a disposable cup and lid with a retractable clamp mechanism in the locked position.
Figure 8B:
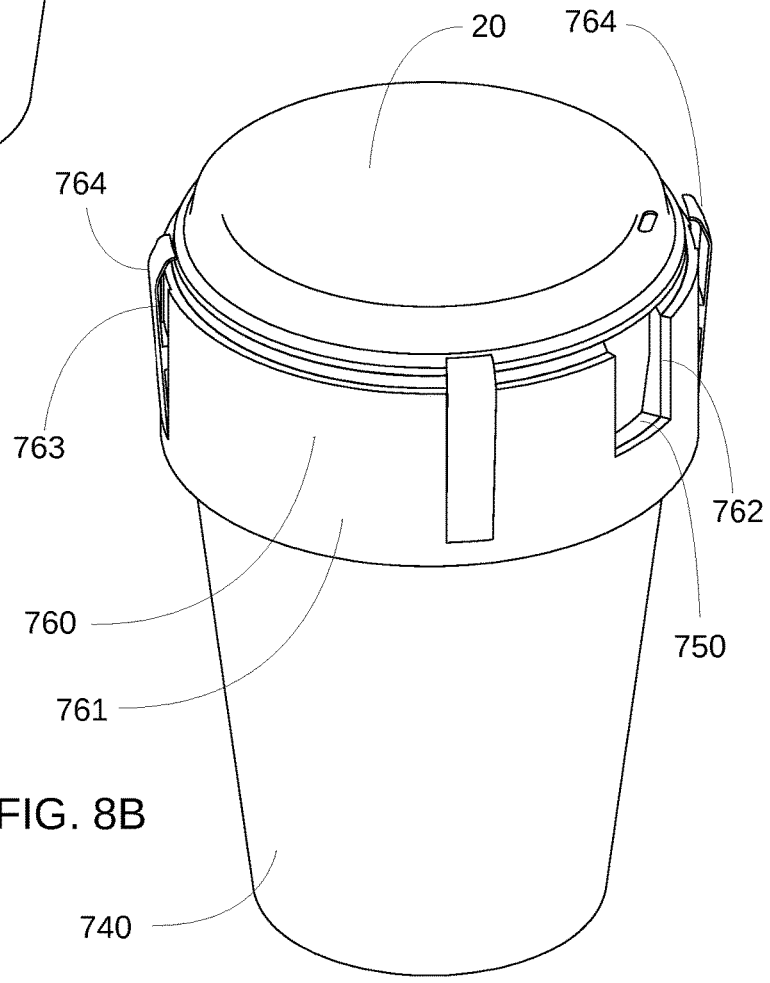
FIG. 8B shows a perspective view of an insulating cup holder containing a disposable cup and lid with a retractable clamp mechanism in the open position.
Figure 8D:
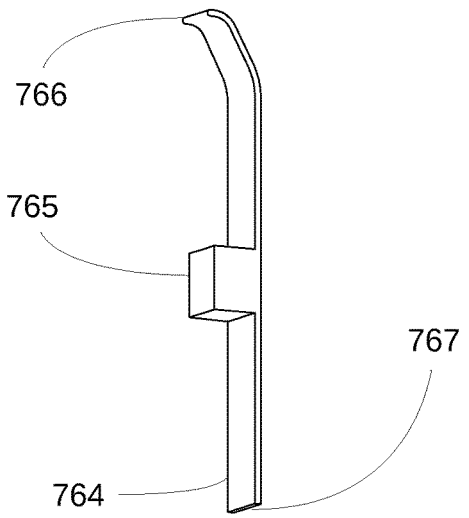
FIG. 8D shows a perspective view of a retractable clamp for an insulating cup holder.
Figure 8E:
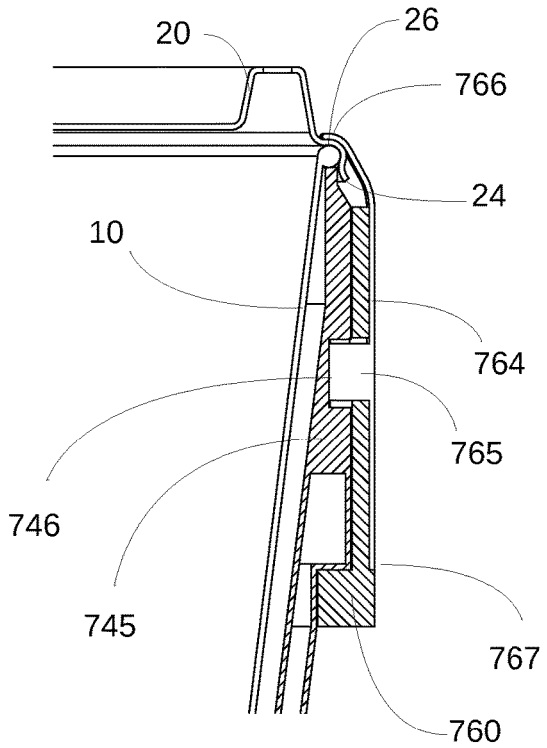
FIG. 8E shows a cross-section view of a portion of an insulating cup holder containing a disposable cup and lid with a retractable clamp mechanism in the locked position acting on the shoulder of the lid.
Figure 8C:
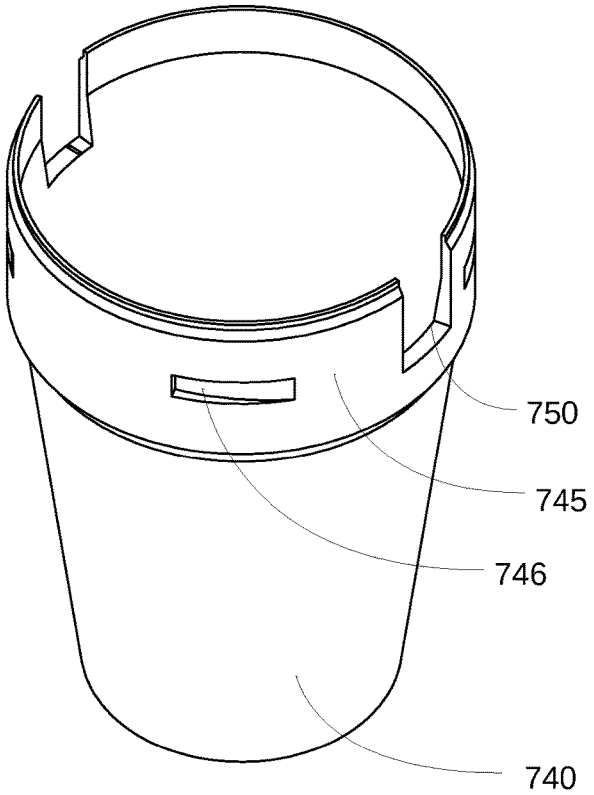
FIG. 8C shows a perspective view of an insulating cup holder having ramps to actuate a retractable clamp mechanism.
Figure 8F:
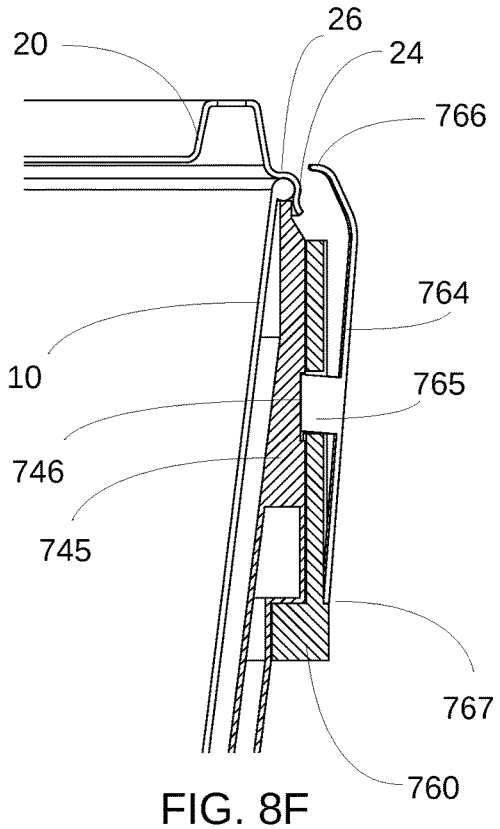
FIG. 8F shows a cross-section view of a portion of an insulating cup holder containing a disposable cup and lid with a retractable clamp mechanism in the open position.

In an embodiment, illustrated in FIGS. 8A through 8F, a beverage cup 10 with an attached lid 20 may be retained within beverage cup holder 740 by means of retractable clamps 764. In FIGS. 8A and 8E, clamps 764 are in the closed position, holding the beverage cup within cup holder 740, while in FIGS. 8B and 8F, clamps 764 are in the open position, allowing a beverage cup to be inserted into or removed from cup holder 740. In the embodiment illustrated in FIGS. 8A through 8F, retractable clamps 764 are actuated by means of a retaining-clamp actuator ring 760, in combination with ramps 746 in wall 745 of cup holder 740. As illustrated in FIG. 8C, cup holder 740 includes a set of ramps 746 in side wall 745. Clamp 764, as illustrated in FIG. 8D, includes a protrusion 765 configured to fit within ramp 746. Clamp 764 also includes a lobe 766 at the top configured to mate with top surface of shoulder 26 of lid 20 when clamp 764 is in the closed position. Finally, clamp 764 includes an attachment point 767 at which it is attached to retaining clamp actuator ring 760. Actuator ring 760 is permanently attached to cup holder 740 such that it may rotate around cup holder 740 on their common axis of cylindrical symmetry. Actuator ring includes recesses 763 to allow clamp 764 to sit flush with the surface of actuator ring 760 when clamp 764 is in the closed position. When actuator ring 760 is twisted with respect to cup holder 740, protrusion 765 of clamp 764 slides up ramp 746, causing clamp 764 to bend outward at attachment point 767 into the open position, allowing cup 10 with lid 20 to be removed from or inserted into cup holder 740. When actuator ring 760 is twisted in the opposite direction, protrusion 765 of clamp 764 slides down ramp 746, allowing clamp 764 to relax into the closed position, in which lobe 766 covers the top of shoulder 26 of lid 20, thereby retaining cup 10 with lid 20 in cup holder 740. Actuator ring 760 also includes a skirt 761 long enough to cover finger-sized slots 750 in cup holder 740. Skirt 761 further includes its own finger-sized slots 762 corresponding to finger-sized slots in cup holder 740 and aligned such that slots 762 will be offset from slots 750 when actuator ring 760 is rotated to place clamps 764 in the closed position and such that slots 762 will align with slots 750 when actuator ring 760 is rotated to place clamps 764 in the open position. Such alignment will ensure that beverage cup 10 is fully enclosed to minimize heat transfer when closed in cup holder 740, and that finger-sized slots are available for a user to hold beverage cup 10 as it is inserted into cup holder 740 when clamps 764 are open to allow such insertion.

Figure 1E:
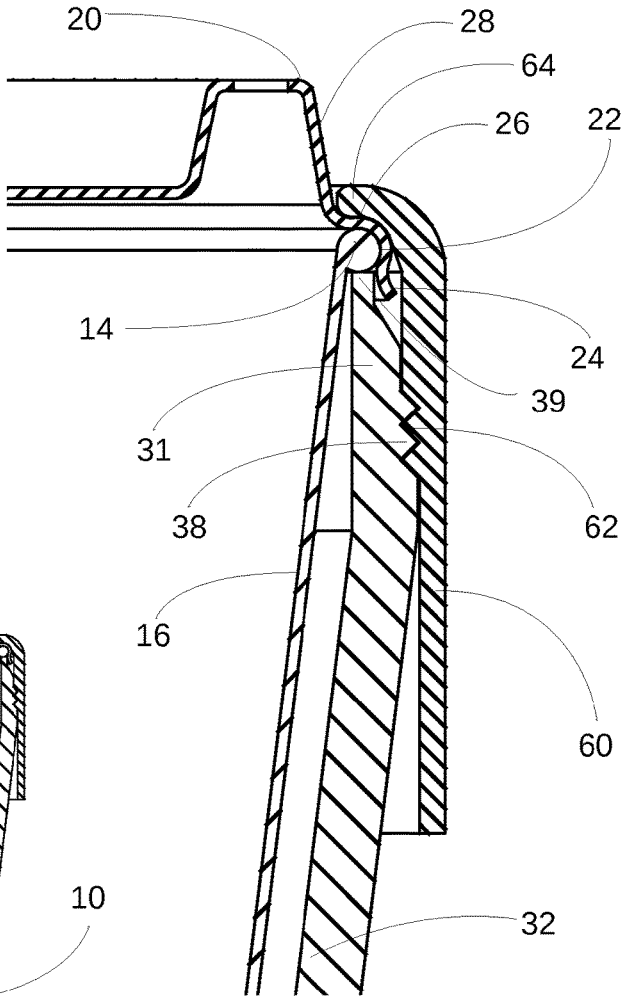
FIG. 1E shows a closeup of a portion of the cup holder, disposable cup, lid, and retaining ring of FIG. 1D.
Figure 1D:
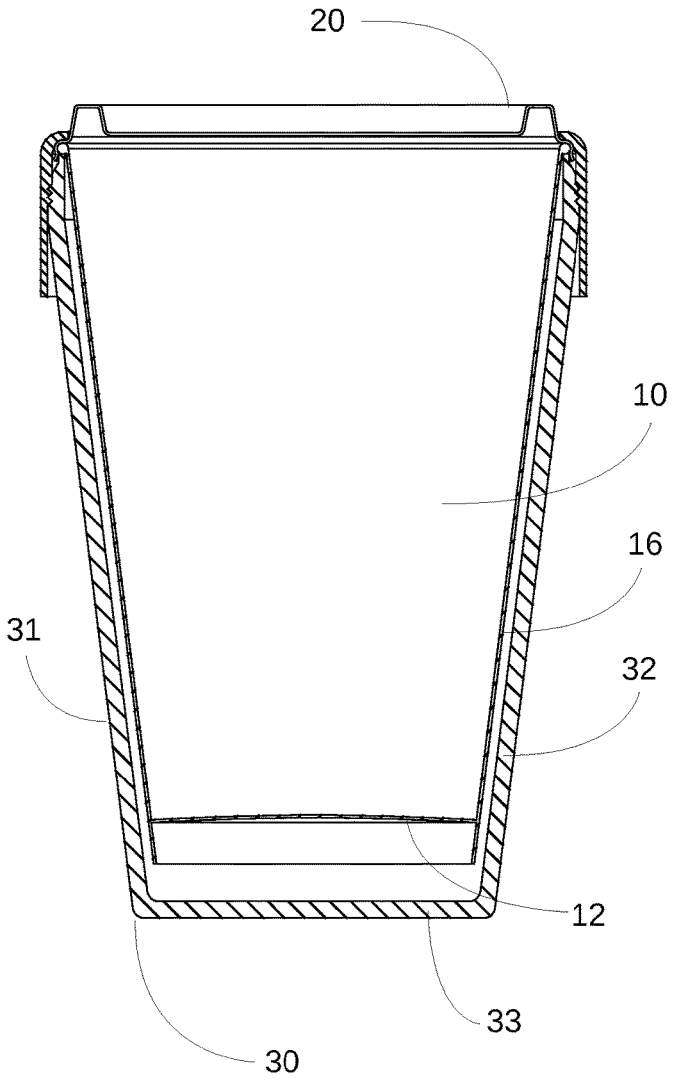
FIG. 1D shows a cross-section view of the cup holder, disposable cup, lid, and retaining ring of FIG. 1C.
Figure 9:
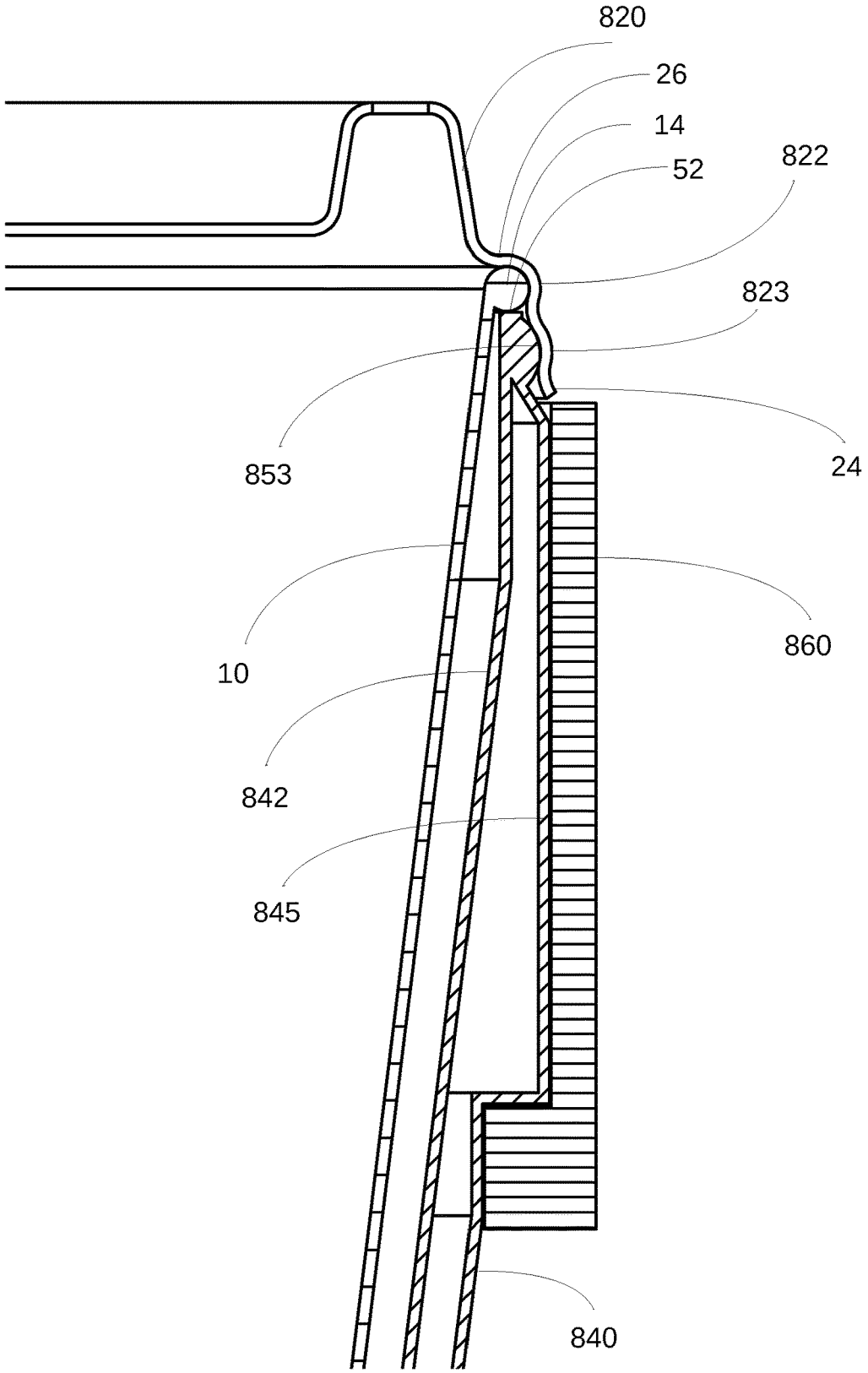
FIG. 9 shows a cross-section view of a portion of an insulating cup holder containing a disposable cup and lid with a snap fit between the lid and the cup holder.

In an embodiment, illustrated in FIG. 9, a beverage cup 10 is held within beverage cup holder 840 by means of a modified disposable beverage cup lid 820. A conventional disposable beverage cup 10 includes a radially-outwardly-extending peripheral bead 14, which provides a mating interface for a disposable lid 20 as illustrated, for example, in FIG. 1E. Also illustrated in FIG. 1E is a conventional disposable lid 20, which includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below circumferential groove 22, such that the skirt provides a guiding surface to assist in aligning the disposable lid for mating on bead 14 of disposable cup 10. In an embodiment, illustrated in FIG. 9, a disposable beverage cup lid 820 includes a first radially-inwardly-opening circumferential groove 822 configured to mate through a snap fit with peripheral bead 14 of disposable cup 10, and a second radially-inwardly-opening circumferential groove 823 displaced axially below first circumferential groove 822. Insulating cup holder 840 includes an inner wall 842 and an outer wall 845 that are joined together along their upper edges forming an upward-facing circular flange 52 along their top-most surfaces. As in other embodiments, circular flange 52 is sized to fit against peripheral bead 14, thereby supporting beverage cup 10 when it is installed in cup holder 840. Below flange 52, cup holder 840 includes a cup-holder peripheral bead 853. Cup-holder peripheral bead 853 is configured to mate through a snap fit with corresponding second radially-inwardly-opening circumferential groove 823 in disposable lid 820. Thus, disposable lid 820 provides a first snap-fit means for attachment to disposable cup 10 and a second snap-fit means for attachment to cup holder 840, thereby holding disposable cup 10 in cup holder 840. It will be appreciated that cup 10 may be inserted into cup holder 840 before lid 820 is attached to cup 10, with the lid 820 being applied after cup 10 is inserted, and secured by snap fit simultaneously to both cup 10 and cup holder 840. Alternatively, lid 820 may be fitted onto cup 10 before cup 10 is inserted into cup holder 840, in which case a downward force applied to shoulder 26 of lid 820 will cause it to attach by snap fit over bead 853 to cup holder 840. Although not illustrated here in the interest of brevity, it will further be appreciated that a user may more easily be able to insert beverage cup 10 into cup holder 840 if cup holder 840 includes finger sized gaps, as illustrated, for example, in FIGS. 2A through 2E, to allow user's fingers to maintain firm contact with the side wall of cup 10 as it is being inserted. It will further be appreciated that the user may prefer to close the finger-sized gaps after cup 10 is inserted into cup holder 840. As such, a rotatable ring 860 is provided such that corresponding gaps may be moved into position to either cover or uncover the finger-sized gaps in a manner analogous to that shown in FIGS. 8A and 8B.

Figure 10A:
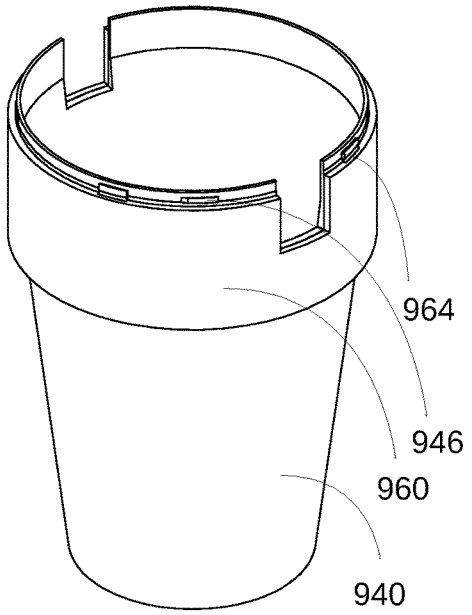
FIG. 10A shows a perspective view of an insulating cup holder having ramps to actuate a retractable clamp mechanism.
Figure 10C:
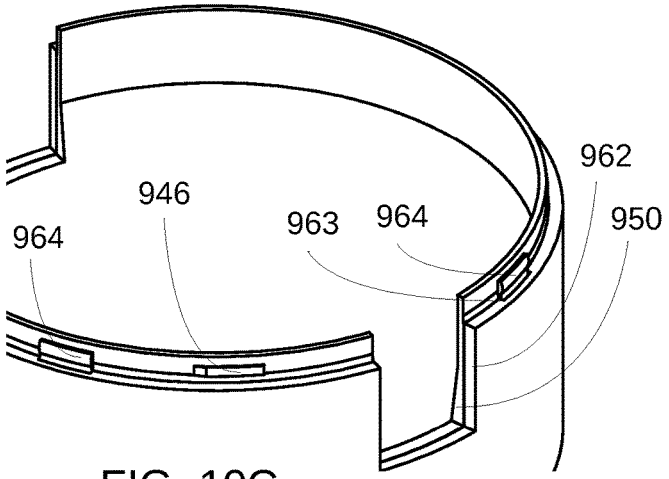
FIG. 10C shows a closeup perspective view of a portion of an insulating cup holder having ramps to actuate a retractable clamp mechanism, with the clamps in the unlocked position.
Figure 10D:
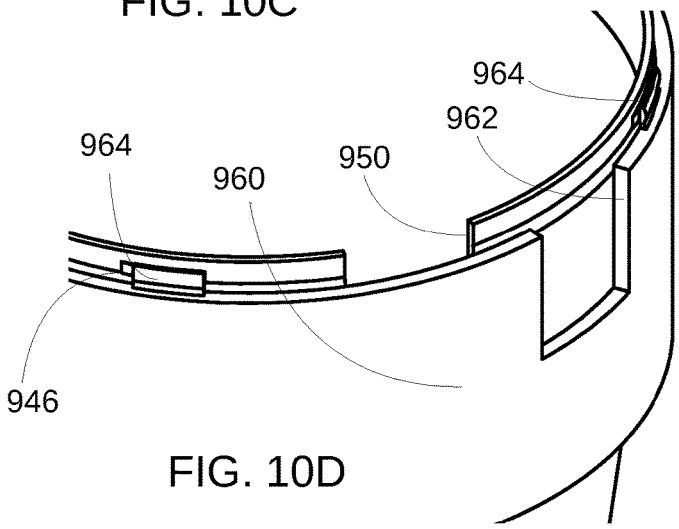
FIG. 10D shows a closeup perspective view of a portion of an insulating cup holder having ramps to actuate a retractable clamp mechanism, with the clamps in the locked position.
Figure 10B:
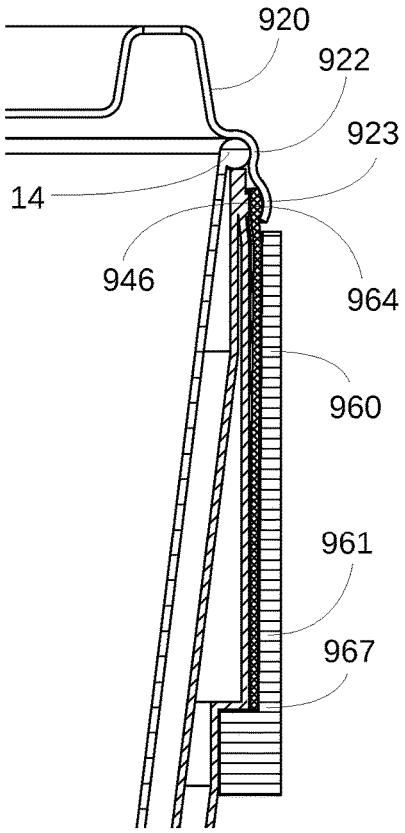
FIG. 10B shows a cross-section view of a portion of an insulating cup holder containing a disposable cup and lid with a retractable clamp mechanism in the locked position acting on the skirt of the lid.
Figure 10E:
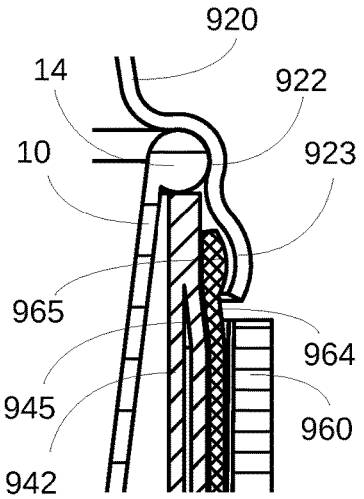
FIG. 10E shows a closeup cross-section view of a portion of an insulating cup holder containing a disposable cup and lid with a retractable clamp mechanism in the unlocked position.
Figure 10F:
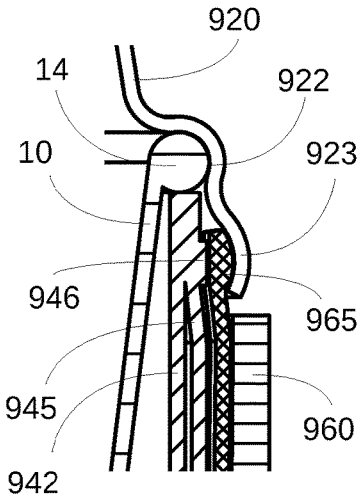
FIG. 10F shows a closeup cross-section view of a portion of an insulating cup holder containing a disposable cup and lid with a retractable clamp mechanism in the locked position acting on the skirt of the lid.

In an embodiment, illustrated in FIGS. 10A through 10F, a beverage cup 10 is held within beverage cup holder 940 by means of a modified disposable beverage cup lid 920 combined with a retractable clamp 964. As in the embodiment illustrated in FIG. 9, disposable beverage cup lid 920 includes a first radially-inwardly-opening circumferential groove 922 configured to mate through a snap fit with peripheral bead 14 of disposable cup 10, and a second radially-inwardly-opening circumferential groove 923 below circumferential groove 922. Insulating cup holder 940 includes a plurality of retractable retraining clamps 964 configured to be retracted when retaining-clamp actuator ring 960 is rotated in one direction and extended when retaining-clamp actuator ring 960 is rotated in the opposite direction. In the embodiment illustrated in FIGS. 10A through 10F, cup holder 940 includes a plurality of radially-extending ramps 946 located near the upper perimeter. Retaining clamps 964 are attached at attachment point 967 to retaining-clamp actuator ring 960 and move with ring 960 as it is twisted around cup holder 940. The upper ends of clamps 964 slide against the surface of cup holder 940 near its upper end as actuator ring 960 is twisted. When actuator ring 960 is twisted to a position, as indicated in FIGS. 10D and 10F, where clamps 964 move over ramps 946, the upper ends of clamps 964 are pushed radially outward to a position where they will engage with second circumferential groove 923 of lid 920, thereby retaining lid 920 and, by extension, cup 10 in cup holder 940. When actuator ring 960 is twisted to a position, as indicated in FIGS. 10C and 10E, where clamps 964 are not in contact with ramps 946, the upper ends of clamps 964 retract radially inward sufficiently to disengage with circumferential groove 923, thereby releasing lid 920 and cup 10 from cup holder 940. As illustrated in FIGS. 10A through 10F, the profile of the upper face of clamps 964 has been selected to match the profile of circumferential groove 923 to provide mechanical contact between the surfaces. It will be appreciated that, while a curved profile was selected for illustration purposes in these figures, alternative profiles, such as triangular or rectangular, may provide an improved mechanical contact for the purpose of holding lid 920 and cup 10 in cup holder 940. Actuator ring 960 also includes a skirt 961 long enough to cover finger-sized slots 950 in cup holder 940. Skirt 961 further includes its own finger-sized slots 962 corresponding to finger-sized slots in cup holder 940 and aligned such that slots 962 will be offset from slots 950 when actuator ring 960 is rotated to place clamps 964 in the closed position, and such that slots 962 will align with slots 950 when actuator ring 960 is rotated to place clamps 964 in the open position. Such alignment will ensure that beverage cup 10 is fully enclosed to minimize heat transfer when closed in cup holder 940, and that finger-sized slots are available for a user to easily insert a beverage cup 10 into cup holder 940 when clamps 964 are open to allow such insertion.

Figure 11A:
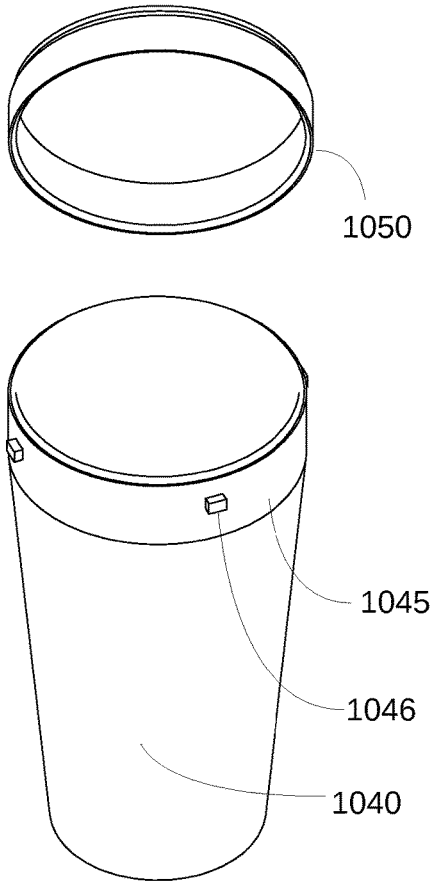
FIG. 11A shows a perspective view of an insulating cup holder and a cup support ring.
Figure 11B:
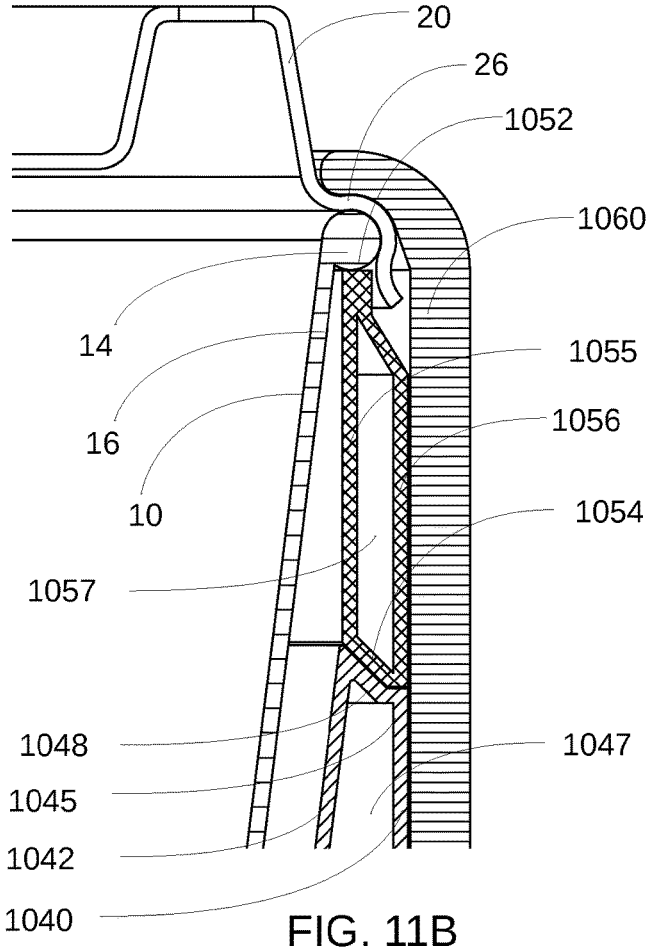
FIG. 11B shows a cross-section view of a portion of an insulating cup holder with a cup support ring and twist-lock retaining ring and containing a disposable cup and lid.
Figures 11C, 11D, 11E, 11F, 11G:
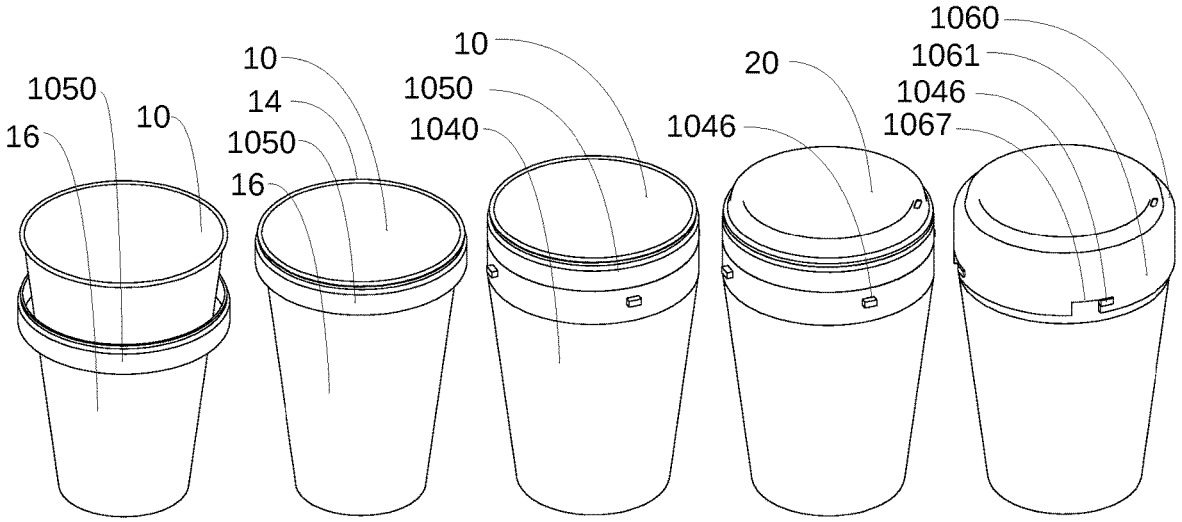
FIG. 11C shows a perspective view of a disposable cup partially inserted into a cup support ring.
FIG. 11D shows a perspective view of a disposable cup fully inserted into a cup support ring.
FIG. 11E shows a perspective view of a disposable cup in a cup support ring inserted into an insulating cup holder.
FIG. 11F shows a perspective view of a disposable cup with a lid in a cup support ring inserted into an insulating cup holder.
FIG. 11G shows a perspective view of a disposable cup with a lid in a cup support ring inserted into an insulating cup holder and held in place with a twist-lock retaining ring.

In various embodiments, described with reference to FIGS. 2 through 9, a cup holder may include finger-sized slots to allow user to maintain a hold on the side wall of a filled beverage container during insertion into the cup holder. In an alternative embodiment, illustrated in FIGS. 11A through 11G, insertion is facilitated through the use of a cup support ring 1050 configured to act as a spacer between cup holder 1040 and beverage cup 10. Cup support ring includes at its top an upward-facing circular flange 1052. The inner diameter of the upward-facing flange 1052 is preferably not smaller than the diameter of side wall 16 of disposable beverage cup 10 at the level of the bottom of bead 14 but not larger than the diameter of the circle formed by the lower-most edge of bead 14. Cup support ring 1050 further includes a lower face 1054 configured to mate with an upper face 1048 of cup holder 1040. As illustrated in FIG. 11B, these two faces may be conical in shape to provide an interface that will ensure stable centering when cup support ring 1050 is stacked on top of cup holder 1040. Cup holder 1040 may be of solid construction or may, as illustrated in FIG. 11B, include an inner wall 1042 and an outer wall 1045 enclosing an insulating space 1047. Similarly, cup support ring 1050 may be of solid construction or may, as illustrated in FIG. 11B, include an inner wall 1055 and an outer wall 1056 enclosing an insulating space 1057. The vertical height of cup support ring 1050 is preferably large enough to provide easy grip between thumb and fingers when held by its outer wall 1056, but small enough that it can be easily covered by skirt 1061 of retaining ring 1060. Cup support ring 1050 facilitates insertion of beverage container 10 into cup holder 1040 through a sequence of steps as illustrated in FIGS. 11C through 10*g*. In FIG. 11C, beverage container 10 is inserted into cup support ring 1050. Because the height of cup support ring 1050 is much shorter than the height of beverage cup 10, the user may maintain contact with wall 16 of cup 10 as it is being inserted into ring 1050. In FIG. 11D, ring 1050 is lifted to a point where it makes contact with bead 14, at which point the user may securely lift and hold beverage cup 10 by grasping only ring 1050 and without need to touch side wall 16. In FIG. 11E, beverage cup 10 is inserted into cup holder 1040 while user holds support ring 1050. In FIG. 11F, lid 20 is applied to cover cup 10. In FIG. 11G, retaining ring 1060 is used to secure the beverage cup in holder 1040 by means of a rotary clamping action analogous to that previously illustrated in FIGS. 6A through 6C. As seen in FIGS. 11A, 11E, 11F, and 11G, cup holder 1040 includes a set of protrusions 1046 extending radially outward from outer wall 1045. As seen in FIG. 11G, retaining ring 1060 includes a matching set of slots 1067 in the bottom of retaining ring skirt 1061. Retaining ring 1060 may be secured to cup holder 1040 by sliding slots 1067 over protrusions 1046 and twisting retaining ring 1060 to lock slots 1067 over protrusions 1046 as illustrated in FIG. 11G. Although a rotary clamping means is used to secure retaining ring 1060 to cup holder 1040 in the embodiment illustrated in FIGS. 11A through 11G, it will be appreciated that alternative means, such as those previously illustrated, may be used to secure a retaining ring to a cup holder when using a cup support ring. Regardless of the means used to secure retaining ring 1060 to cup holder 1040, when fully assembled, as illustrated in FIG. 11B, retaining ring 1060 provides a downward force on shoulder 26 of lid 20 and successively through bead 14 of cup 10, cup support ring 1050, to cup holder 1040, thereby creating a stable assembly and securely holding cup 10 in cup holder 1040.

Figure 12A:
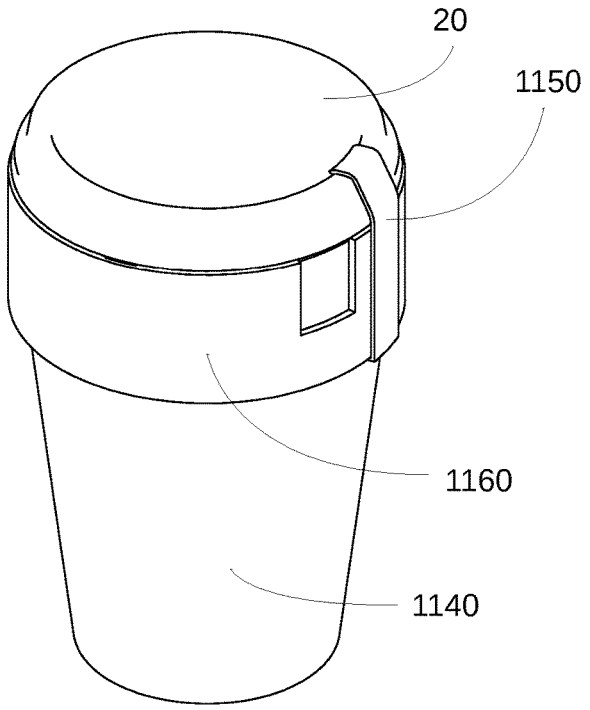
FIG. 12A shows a perspective view of a disposable cup with a lid in an insulating cup holder with a drinking port cover in the closed position.
Figure 12B:
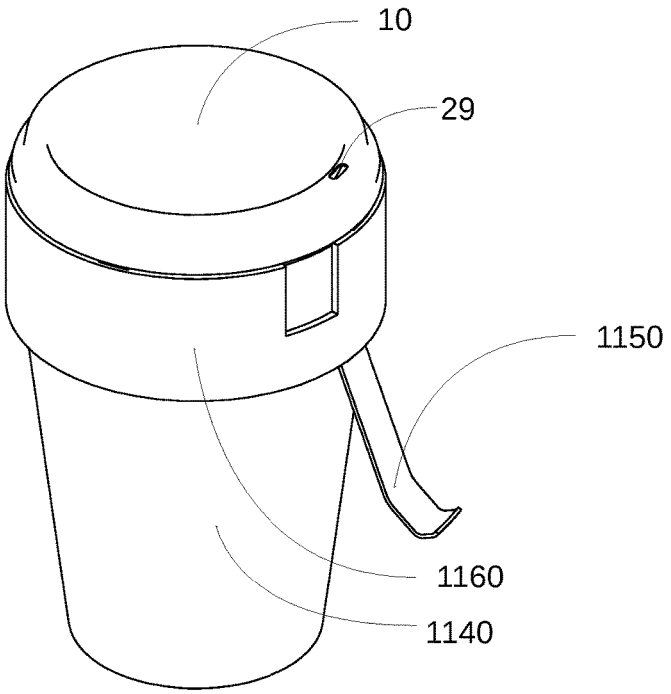
FIG. 12B shows a perspective view of a disposable cup with a lid in an insulating cup holder with a drinking port cover in the open position.
Figure 12C:
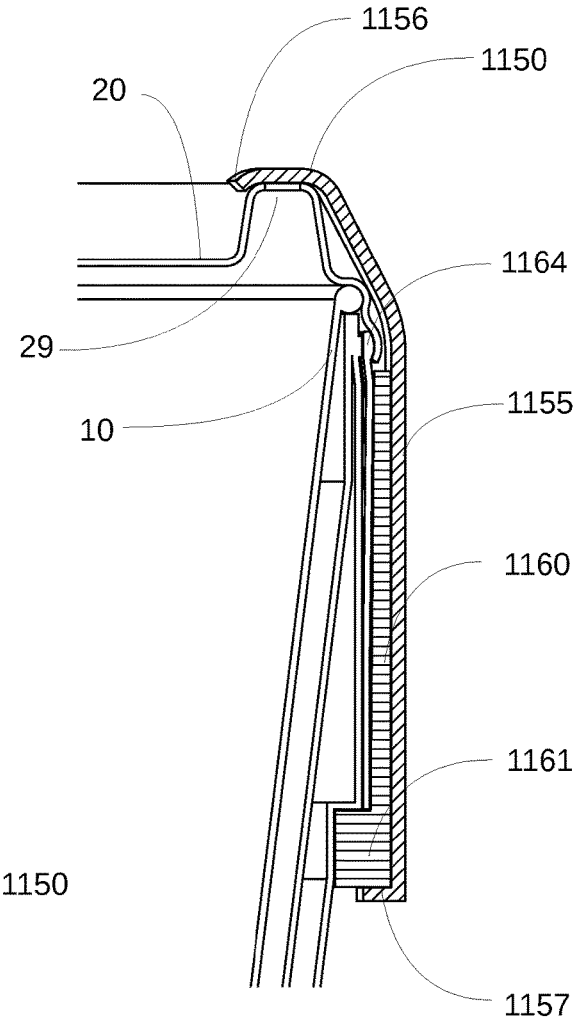
FIG. 12C shows a cross-section view of a portion of a disposable cup with a lid in an insulating cup holder with a drinking port cover in the closed position.

One object of the present invention is to secure a disposable beverage cup within an insulating cup holder to minimize the chance of a spill. In embodiments described above, a cup with an attached lid is securely held in an insulating cup holder by various means, and if the cup holder should accidentally be overturned, the cup and lid will remain in the holder and the lid will remain on the cup, preventing an instant spill. However, disposable beverage cup lids typically have a drinking port, which could allow a slow spill of a beverage from an overturned beverage cup holder even when the cup and lid remain securely held within the cup holder. This possibility can be reduced by including a drinking port cover capable of sealing the drinking port when not in use. In an embodiment illustrated in FIGS. 12A, 12B, and 12C, a drinking port cover 1150 is provided to alternately cover or uncover drinking port 29 in lid 20 when a disposable beverage cup 10 is secured within insulating cup holder 1140. In this embodiment, beverage cup 10 with lid 20 is secured in insulating cup holder 1140 by means of retractable clamps 1164 as previously illustrated in FIGS. 10A through 10*f*. It will be appreciated that this means of securing the beverage cup in the insulating cup holder was selected here for illustration purposes and that a drinking port cover as described here may be combined with other means for securing a beverage cup in an insulating cup holder as described in various embodiments above. In the embodiment illustrated in FIGS. 12A, 12B, and 12C, drinking port cover 1150 includes a rigid hook 1156 shaped to match the contour of disposable lid 20 around drinking port 29, an attachment means 1157 to secure it to retaining clamp actuator ring 1160 and a flexible stem 1155 that may stretch to allow hook 1156 to be pulled over lid 20 to cover port 29. When hook 20 is placed over port 29 as indicated in FIGS. 12A and 12C, flexible stem 1155 is stretched beyond its relaxed position and so provides a downward force to hold hook 1156 over port 29. When port cover 1150 is removed to expose port 29 for drinking, port cover 1150 remains attached to actuator ring 1160 as indicated in FIG. 12B. It will be appreciated that the attachment between cover 1150 and actuator ring 1160 illustrated in FIGS. 12A, 12B, and 12C was selected for illustration purposes and that in other embodiments drinking port cover 1150 may instead be attached to insulating cup holder 1140.

Figure 13:
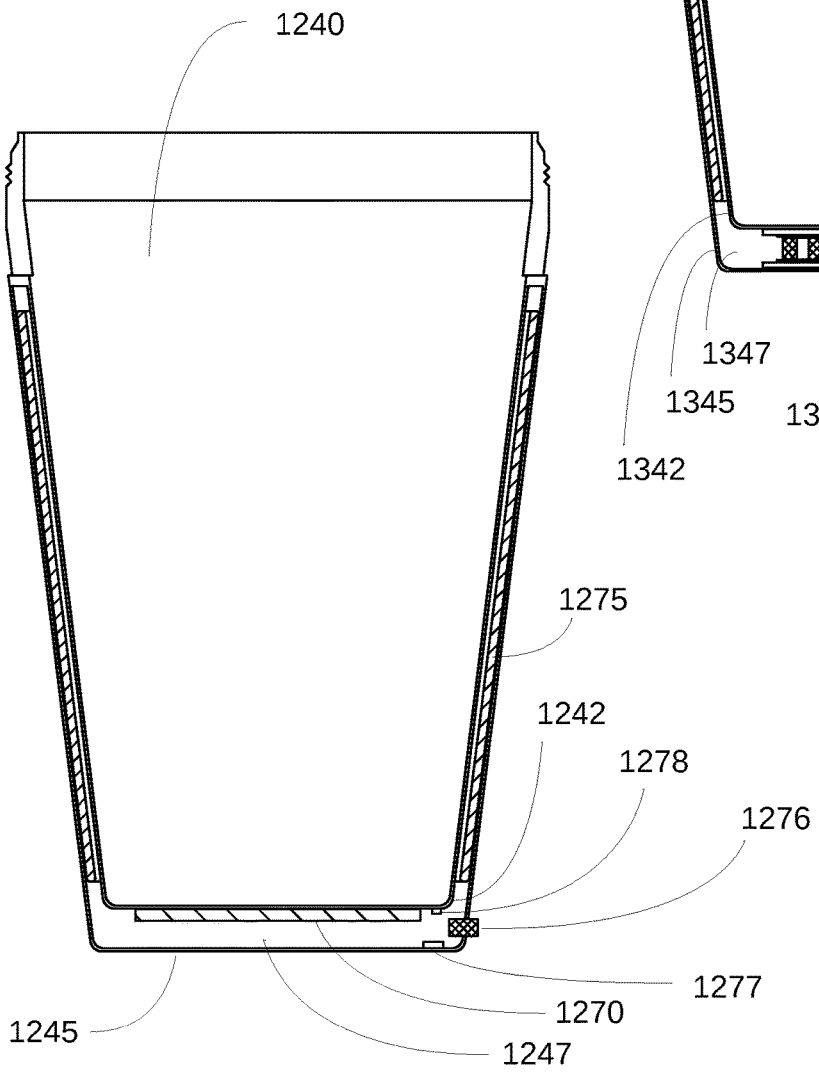
FIG. 13 shows a cross-section view of an insulating cup holder with an electric resistance heater.

An object of the present invention is to provide a means for holding a disposable beverage cup and minimizing heat transfer between the beverage cup and the surrounding environment in order to maintain its contents at a temperature preferred for drinking. It will be appreciated that, while various forms of insulation may reduce heat transfer, no insulation system is perfect and the temperature of a beverage contained within an insulating cup holder will gradually approach the temperature of the environment. In an embodiment illustrated in FIG. 13, the time period over which a hot beverage may be maintained at a temperature above the temperature of the environment may be extended by use of an electrical resistance heating element 1270 attached to inner wall 1242 of insulating cup holder 1240. In this embodiment, power for heating element 1270 is provided by battery 1275, which is contained in insulating space 1247 between inner wall 1242 and outer wall 1245 of insulating cup holder 1240. Battery 1275 may be recharged through charging port 1276. The temperature of inner wall 1242 is measured by temperature sensor 1278 and power to heating element 1270 is controlled by controller 1277 which monitors temperature sensor 1278 and applies power to heating element 1270 when the temperature of inner wall 1242 falls below a setpoint defining the preferred temperature of the beverage contained in insulating cup holder 1240. The temperature may be selected by the user by various means (not shown) including by wired connection during battery charging, by temperature selection controls on the external surface of cup holder 1240, or by wireless means through, for example, a smartphone application.

Figure 14:
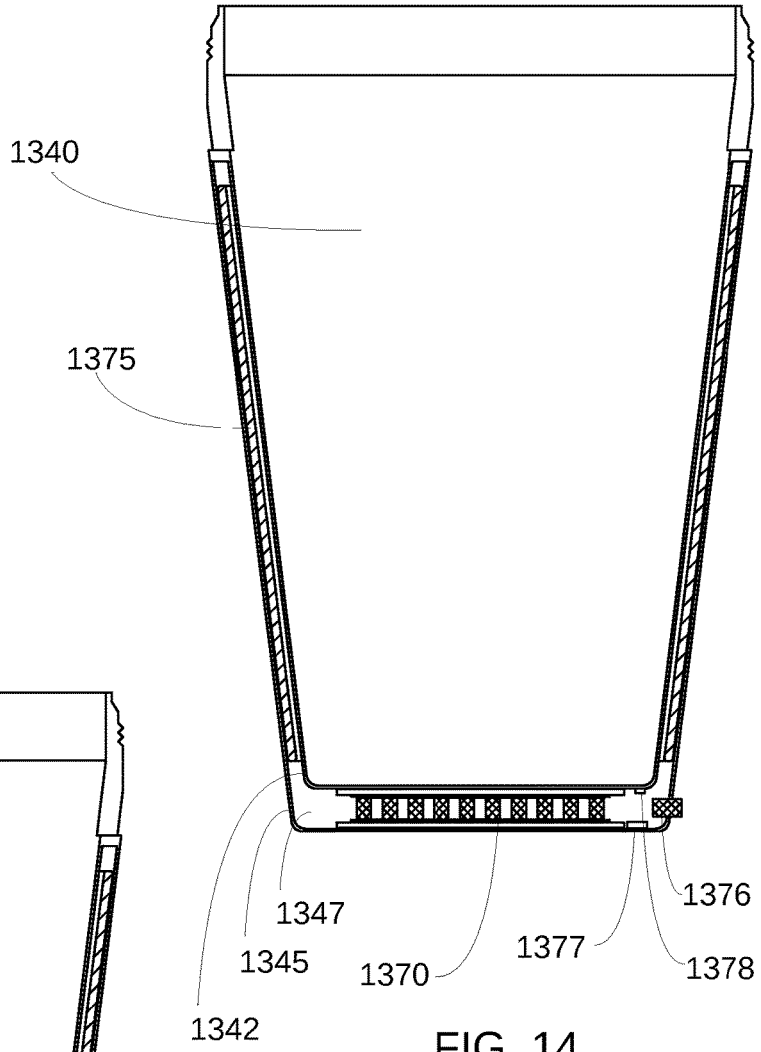
FIG. 14 shows a cross-section view of an insulating cup holder with a thermoelectric temperature-control module.

In another embodiment, illustrated in FIG. 14, the temperature of the interior of insulating beverage cup holder 1340 is controlled through the use of a thermoelectric element 1370 that connects to, and transfers heat between, inner wall 1342 and outer wall 1345. A thermoelectric element may allow heat transfer in either direction, thereby making it possible to maintain the temperature of the interior of cup holder 1340 either above or below the temperature of the environment. In this embodiment, power for thermoelectric element 1370 is provided by battery 1375 which is contained in insulating space 1347 between inner wall 1342 and outer wall 1345 of insulating cup holder 1340. Battery 1375 may be recharged through charging port 1376. The temperature of inner wall 1342 is measured by temperature sensor 1378 and power to thermoelectric element 1370 is controlled by controller 1377 which monitors temperature sensor 1378 and applies power to thermoelectric element 1370 to either heat inner wall 1342 when the temperature of inner wall 1342 falls below a setpoint defining a preferred temperature of a hot beverage contained in insulating cup holder 1340, or to cool inner wall 1342 when the temperature of inner wall 1342 rises above a setpoint defining a preferred temperature of a cold beverage contained in insulating cup holder 1340. The temperature may be selected by the user by various means (not shown) including by wired connection during battery charging, by temperature selection controls on the external surface of cup holder 1340, or by wireless means through, for example, a smartphone application.

The various components described herein can be combined to produce an insulating cup holder that will provide a secure support for a disposable beverage cup with a lid, provide a method for simple and secure insertion of a disposable beverage cup with or without a lid into the beverage cup holder, provide a means for maintaining the beverage in the cup at or near a preferred temperature, and provide a means for minimizing the potential for spilling a beverage contained in the beverage cup. It will be readily understood by practitioners in the art that the components of the various embodiments as described above may be combined in a variety of configurations, and that not all of the features of the present invention need be combined in in any single embodiment of the invention. It will further be understood that the insulating beverage cup holder may be manufactured using any of a variety of materials including, for example, plastics and metals, within the intent of this invention. While the intent of this invention is to provide a means for securely holding a conventional disposable beverage cup with a lid, and controlling heat flow to and from a beverage contained in the cup, it will further be understood that the invention may be used with a non-disposable beverage cup and/or lid fabricated in the shape of a conventional disposable beverage cup and/or lid but fabricated from more durable and/or washable materials, for example, plastics and metals, within the intent of this invention.

This invention has been described in its currently contemplated best embodiment, and it is clear that it is susceptible to numerous modifications, modes, and embodiments within the ability of those skilled in the art and without the exercise of the inventive faculty. Accordingly, the scope of this invention is defined by the scope of the following claims.

What is claimed is:

1. An assembly for holding a beverage cup comprising a peripheral bead, the assembly comprising:

a cup holder comprising a closed bottom, a generally cylindrical or frustoconical side wall having an inner surface and an outer surface, and an upper access opening configured to receive the beverage cup, wherein the side wall of the cup holder comprises an upward-facing flange configured to support the peripheral bead, wherein the side wall and flange of the cup holder incorporate two or more finger gaps sized to allow a user to hold the beverage cup with two or more fingers while inserting the beverage cup into the holder; and a retaining ring comprising a skirt, an inward facing lobe, and a central opening, the skirt and the outer surface of the side wall comprising attachment means that engage at a location on the outer surface of the side wall, such that when the attachment means fully engages the retaining ring to the cup holder, the inward facing lobe is spaced at a predetermined distance from the upward-facing flange so as to define a gap between the inward facing lobe and the upward-facing flange, and the skirt at least partially covers the two or more finger gaps, wherein when the beverage cup is inserted into the cup holder and the attachment means are engaged, the peripheral bead fits within the gap between the inward facing lobe and the upward-facing flange.

2. The assembly of claim 1, wherein the upward-facing flange is configured to support the peripheral bead at a circular line of contact having a diameter, and wherein the lobe has an inner diameter not more than the diameter of the circular line of contact.

3. The assembly of claim 1, wherein the skirt completely covers the two or more finger gaps.

4. The assembly of claim 1, wherein the two or more finger gaps comprise three finger gaps sized to allow a user to hold the beverage cup with three fingers while inserting the beverage cup into the cup holder.

5. The assembly of claim 4, wherein one of the three finger gaps is larger than the other two of the three finger gaps.

6. The assembly of claim 5, wherein the larger gap is disposed opposite the other two of the three finger gaps.

7. The assembly of claim 1, wherein when the attachment means fully engages the retaining ring to the cup holder, the attachment means spaces the lobe at a sufficient distance from the flange to apply a downward force on the peripheral bead.

8. The assembly of claim 7, wherein the beverage cup further comprises a lid, wherein the lid includes a shoulder that rests on top of the peripheral bead, a neck, and an opening in the neck to provide a drinking port, wherein when the attachment means fully engages the retaining ring to the cup holder, the attachment means spaces the lobe at a distance from the flange to further apply a downward force on the shoulder of the lid.

9. The assembly of claim 8, wherein the assembly further comprises the beverage cup and the lid, wherein the lid includes the neck; and wherein the lobe has an inner diameter not less than an outer diameter of the neck.

10. The assembly of claim 1, wherein the attachment means comprises a threaded connection.

11. The assembly of claim 1, wherein the attachment means comprises a snap connection.

12. The assembly of claim 1, wherein the attachment means comprises a magnetic connection.

13. The assembly of claim 1, wherein the attachment means comprises a rotary clamp connection.

14. The assembly of claim 1, wherein the attachment means comprises a hinge.

15. The assembly of claim 1, wherein the attachment means comprises a retractable clamp.

16. The assembly of claim 1, wherein the side wall comprises insulating means reducing heat flow to or from the beverage cup.

17. The assembly of claim 1, further comprising an electrical resistance heater for heating at least a portion of the assembly.

18. The assembly of claim 1, wherein the side wall is generally frustoconical.

19. The assembly of claim 1, wherein the two or more finger gaps create interruptions in the attachment means.

20. A method of preparing an assembly, the method comprising:

inserting a beverage cup comprising a peripheral bead into a cup holder, the cup holder comprising a closed bottom, a generally cylindrical or frustoconical side wall comprising an inner surface, an outer surface, an upward-facing flange, and an upper access opening receiving the beverage cup, wherein the side wall and flange of the cup holder incorporate two or more finger gaps allowing a user to hold the beverage cup with two or more fingers while inserting the beverage cup into the holder;

supporting the peripheral bead using the upward-facing flange; and engaging a retaining ring with the outer surface of the side wall using attachment means, the retaining ring comprising a skirt and an inward facing lobe, the attachment means fully engaging at a location on the outer surface of the side wall such that the inward facing lobe is spaced at a predetermined distance from the upward-facing flange so as to define a gap between the inward facing lobe and the upward-facing flange within which the peripheral bead fits, and the skirt at least partially covers the two or more finger gaps.

21. The method of claim 20, wherein the upward-facing flange supports the peripheral bead at a circular line of contact having a diameter, and wherein the lobe has an inner diameter not more than the diameter of the circular line of contact.

22. The method of claim 20, wherein the skirt completely covers the two or more finger gaps.

23. The method of claim 20, wherein the two or more finger gaps comprise three finger gaps sized to allow a user to hold the beverage cup with three fingers while inserting the beverage cup into the cup holder.

24. The method of claim 23, wherein one of the three finger gaps is larger than the other two of the three finger gaps.

25. The method of claim 24, wherein the larger finger gap is disposed opposite the other two finger gaps.

26. The method of claim 20, wherein the lobe applies a downward force on the peripheral bead when the attachment means fully engages the retaining ring to the cup holder.

27. The method of claim 26, wherein the beverage cup further comprises a lid, wherein the lid includes a shoulder that rests on top of the peripheral bead, a neck, and an opening in the neck to provide a drinking port, wherein the lobe further applies a downward force on the shoulder of the lid when the attachment means fully engages the retaining ring to the cup holder.

28. The method of claim 27, wherein the lobe has an inner diameter not less than an outer diameter of the neck.

29. The method of claim 20, wherein the retaining ring and the side wall engage using a threaded connection.

30. The method of claim 20, wherein the retaining ring and the side wall engage using a snap connection.

31. The method of claim 20, wherein the retaining ring and the side wall engage using a magnetic connection.

32. The method of claim 20, wherein the retaining ring and the side wall engage using a rotary clamp connection.

33. The method of claim 20, wherein the retaining ring and the side wall engage using a hinge.

34. The method of claim 20, wherein the retaining ring and the side wall engage using a retractable clamp.

35. The method of claim 20, wherein the side wall comprises insulating means reducing heat flow to or from the beverage cup.

36. The method of claim 20, further comprising heating the beverage cup using an electrical resistance heater within the cup holder.

37. The method of claim 20, wherein the side wall is generally frustoconical.

* * * * *